US008408759B1

(12) United States Patent
Rashidi

(10) Patent No.: US 8,408,759 B1
(45) Date of Patent: Apr. 2, 2013

(54) LED LIGHTING LUMINAIRE HAVING HEAT DISSIPATING CANISTER HOUSING

(76) Inventor: Hamid Rashidi, Beverly Hills, CA (US)

( * ) Notice: Subject to any disclaimer, the term of this patent is extended or adjusted under 35 U.S.C. 154(b) by 392 days.

(21) Appl. No.: 12/657,137

(22) Filed: Jan. 13, 2010

(51) Int. Cl.
*F21V 29/00* (2006.01)

(52) U.S. Cl. ..... 362/373; 362/294; 362/240; 362/364; 362/430; 362/150

(58) Field of Classification Search ..... 362/218, 362/240, 294, 364, 365, 366, 373, 430, 148, 362/150
See application file for complete search history.

(56) References Cited

U.S. PATENT DOCUMENTS

| | | | | |
|---|---|---|---|---|
| 2,465,248 | A * | 3/1949 | McCandless | 362/304 |
| 3,040,172 | A * | 6/1962 | Chan | 362/257 |
| 4,336,575 | A * | 6/1982 | Gilman | 362/147 |
| 4,450,512 | A * | 5/1984 | Kristofek | 362/276 |
| 7,396,146 | B2 * | 7/2008 | Wang | 362/294 |
| 7,661,854 | B1 * | 2/2010 | Yang et al. | 362/373 |
| 7,722,227 | B2 * | 5/2010 | Zhang et al. | 362/364 |
| 7,871,184 | B2 * | 1/2011 | Peng | 362/294 |
| 7,874,702 | B2 * | 1/2011 | Shuai et al. | 362/294 |
| 7,959,332 | B2 * | 6/2011 | Tickner et al. | 362/373 |
| 2008/0106907 | A1 * | 5/2008 | Trott et al. | 362/368 |
| 2008/0165535 | A1 * | 7/2008 | Mazzochette | 362/294 |
| 2008/0304269 | A1 * | 12/2008 | Pickard et al. | 362/365 |
| 2009/0027889 | A1 * | 1/2009 | Kang et al. | 362/294 |
| 2009/0129086 | A1 * | 5/2009 | Thompson, III | 362/249.02 |
| 2010/0061108 | A1 * | 3/2010 | Zhang et al. | 362/364 |
| 2010/0110699 | A1 * | 5/2010 | Chou | 362/373 |
| 2010/0296272 | A1 * | 11/2010 | Roos et al. | 362/147 |

* cited by examiner

*Primary Examiner* — Ismael Negron
(74) *Attorney, Agent, or Firm* — Thomas I. Rozsa

(57) ABSTRACT

A canister for use with a luminaire, the canister having an interior heat sink incorporated into and within a top cover of the canister and a source of illumination retained within the canister. The heat sink includes a multiplicity of air fins separated by air gaps, the air fins extending radially from an interior wall of the cover. The heat sink also includes a multiplicity of air fins separated by air gaps, the air fins extending radially from an interior wall of the canister. The top cover has an opening and a removable sealing cap having a recessed surface extends into an interior of the top cover when affixed to the top cover to enclose the opening.

66 Claims, 27 Drawing Sheets

LED LIGHTING LUMINAIRE HAVING HEAT DISSIPATING CANISTER HOUSING

BACKGROUND OF THE INVENTION

1. Field of the Invention

The present invention relates to the field of recessed lighting luminaires and in particular to recessed lighting luminaires which are housed in a canister which is retained in the ceiling of a structure.

2. Description of the Prior Art

With the development of semiconductor lighting devices, LED lighting sources are in great demand in lighting luminaires used in both consumer and industrial markets. One problem with LED lighting luminaires and in particular with recessed lighting luminaires is that the LED lamp generates considerable heat and due to its confined space in a ceiling of a structure, heat dissipation is difficult to achieve. Excess heat can result in failure of the operating components of the lighting luminaire.

One problem with prior art recessed lighting luminaires is that the luminaire is housed in a metal canister which is a metal shell that has no mechanism to dissipate heat. As a result, the components of the illumination means can become very hot and therefore their life is reduced.

Particularly, in the current market for recessed lighting luminaires having the LED lighting sources, multiple LED chips are permanently affixed to a luminaire. Therefore, this design creates at least two problems. First, it is different to control the light distribution, and this creates more chance of component failure. Second the existing light luminaires become potentially obsolete if the LED technology advances and it is not possible to replace and upgrade the LED chip.

There is a significant need to provide an improved design for a lighting luminaire which solves the problems associated with prior art designs.

SUMMARY OF THE INVENTION

The present invention is a recessed lighting fixture utilizing LED lamps or conventional bulbs which includes significant design improvements in the metal canister in which the illumination means are housed.

In the present invention, the top of the canister is modified to have a heat sink incorporated into the top of the canister. The canister has been modified to have a heavy cast aluminum top with interior air veins and a depressed cap so that the heat from the LED or other illumination source is dissipated by the heat sink on the top of the canister. In prior art designs, there is no such heat sink and the metal canister is just thick aluminum so that the LED can heat up to 90 degrees centigrade.

The benefit of the present invention is that it allows the LED to run cooler than the prior art design. In the present invention the LED runs between 70 degrees centigrade and 75 degrees centigrade which is fifteen degrees centigrade lower than the maximum that the manufacturer requires. The heat sink therefore enables the LED to have a longer life.

Another innovation is that the cap on the top of the canister is indented so that it goes into the well which surrounds the interior veins so that it creates greater surface area for heat dissipation. This is much more effective than if the cap were flat along the top of the canister. A plate at the bottom of the heat sink has interior holes which allows for further dissipation of heat and circulation of air.

In addition, inside the canister itself there are interior air veins which further serve to dissipate the heat.

Therefore, the present invention contains structural improvements to thereby achieve unique properties as follows:

The first improvement of the present invention is to design a domed cover which is made of the heavy cast aluminum. The domed cover has a contoured top surface which maximizes and facilitates air flow to thereby contribute to efficient heat dissipation. In addition, the domed cover is designed to have a large radius and intimate contact with the sidewall of the canister, both of which serve to maximize the surface areas of the canister to facilitate efficient heat dissipation.

The second improvement of the present invention is the design of the upper and lower heat dissipation fins or veins, which have the respective large surface areas to provide for efficient heat dissipation. In addition, the thickness and width of the air gaps adjacent to each fin or vein are optimized so that the present invention enables each fin or vein to achieve maximum heat exchange.

The third improvement of the present invention is to have a plurality of openings positioned on a transverse plate of the canister, which serves to promote air flow within the canister to thereby contribute to efficient heat dissipation.

The fourth improvement of the present invention is to have a single LED chip to provide white light, which allows better control of light distribution and less possible points of failure. In the prior art, the LED has several colored chips to provide white light.

The fifth improvement of the present invention is the design wherein the LED chip has four connecting openings positioned at the respective corners of the chip to affix the chip with greater stability. In addition, the present incorporates a thermal conductive grease which is positioned on the rear side of the LED chip. Therefore, with four affixing means positioned at the respective corners of the chip, the chip can be evenly and removably positioned on a transverse plate within the luminaire for efficiently transferring heat generated by the LED in use and to facilitate replacement of the LED chip if it fails or if it is desired to upgrade the LED chip with a more current model.

The sixth improvement of the present invention is the design of a recessed sealing cover, which provides a large surface area for the heat dissipation and facilitates compliance with the local state regulations which require the luminaire to be sealed.

The seventh improvement of the present invention is the incorporation of a replaceable light reflector which is affixed with a lens designed for generating a specific lighting effect, so that the present invention is able to provide a narrow flood, flood and wide flood lighting effect.

The eighth improvement of the present invention is the design of the hanger bars which can be installed on the long or the short sides of the housing, which provides fore more versatile installation of the luminaire in a building structure which may have different sizes of ceiling openings to receive the luminaire.

Therefore, it is an object of the present invention to provide a lighting luminaire which possesses the above illustrated structural improvements to thereby achieve benefits of low cost, ease of manufacture and repair, excellent lighting effects, significantly improved heat dissipation, and a luminaire which has long usable life.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

Figure 9A:
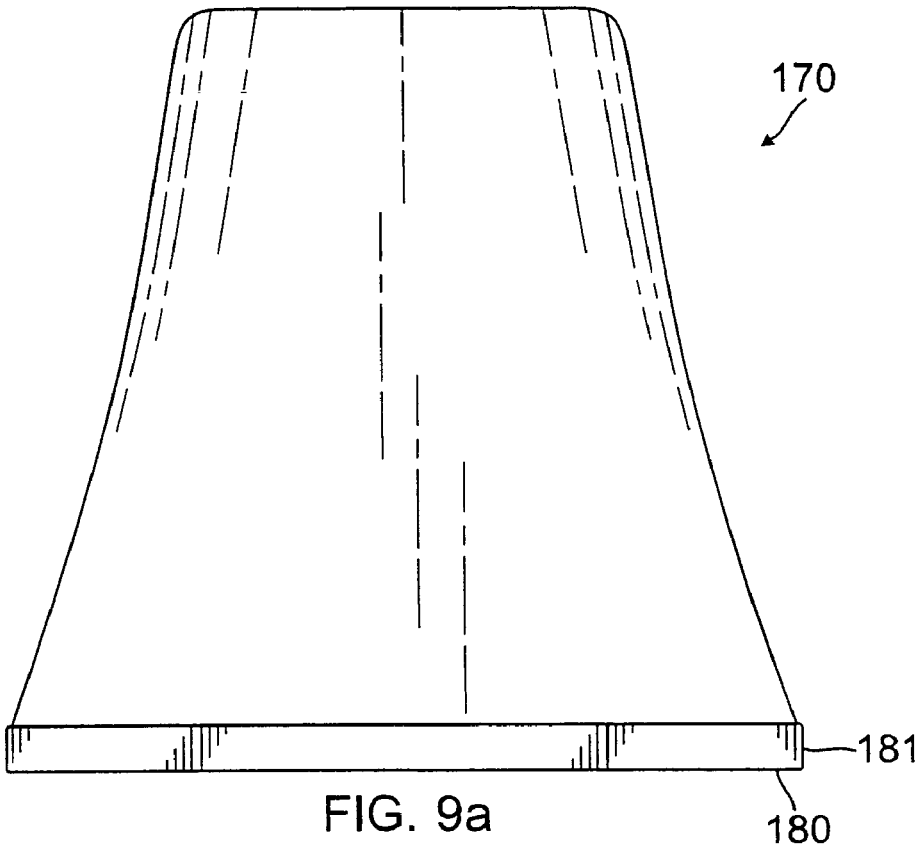
Figure 9B:
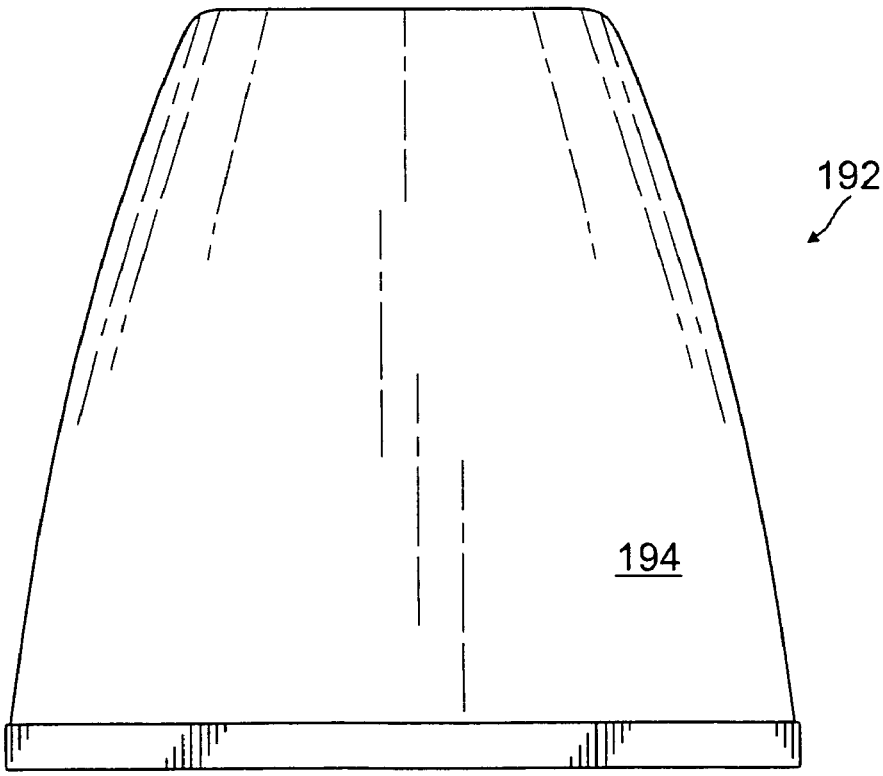
Figure 9C:
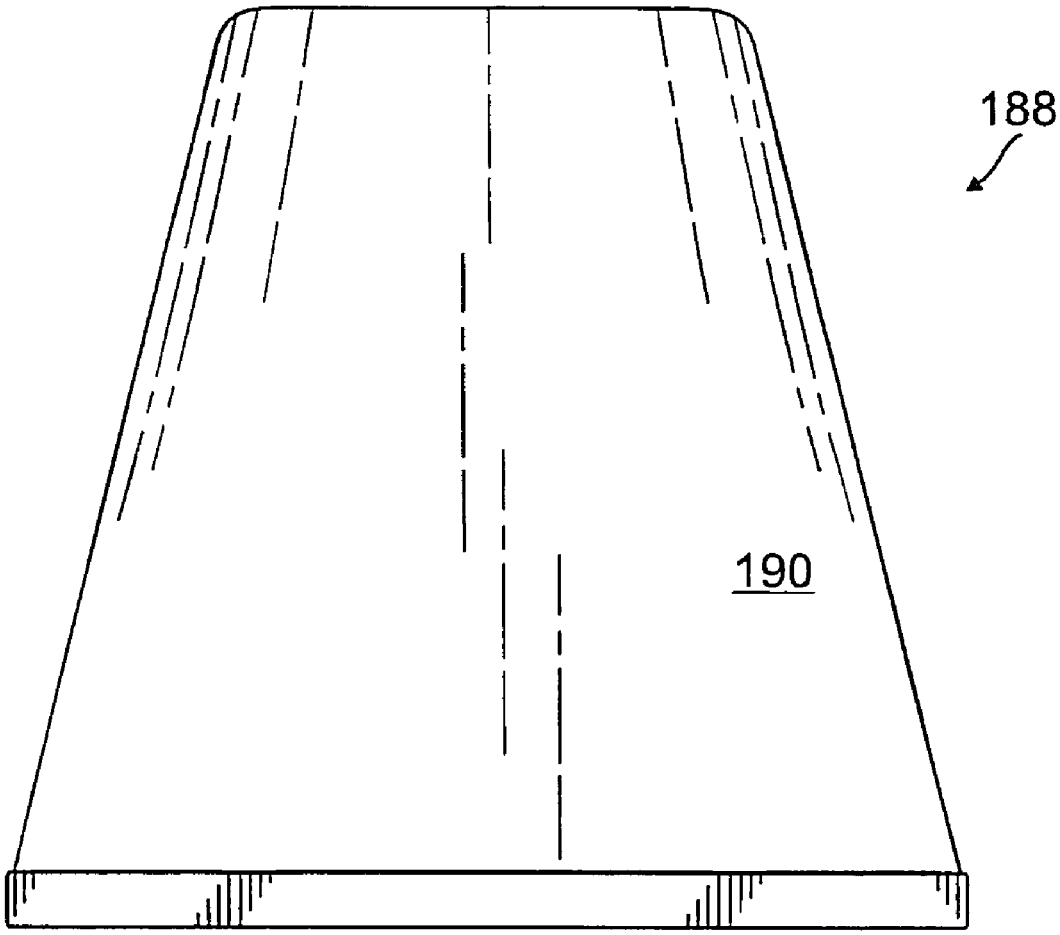
Figure 10:
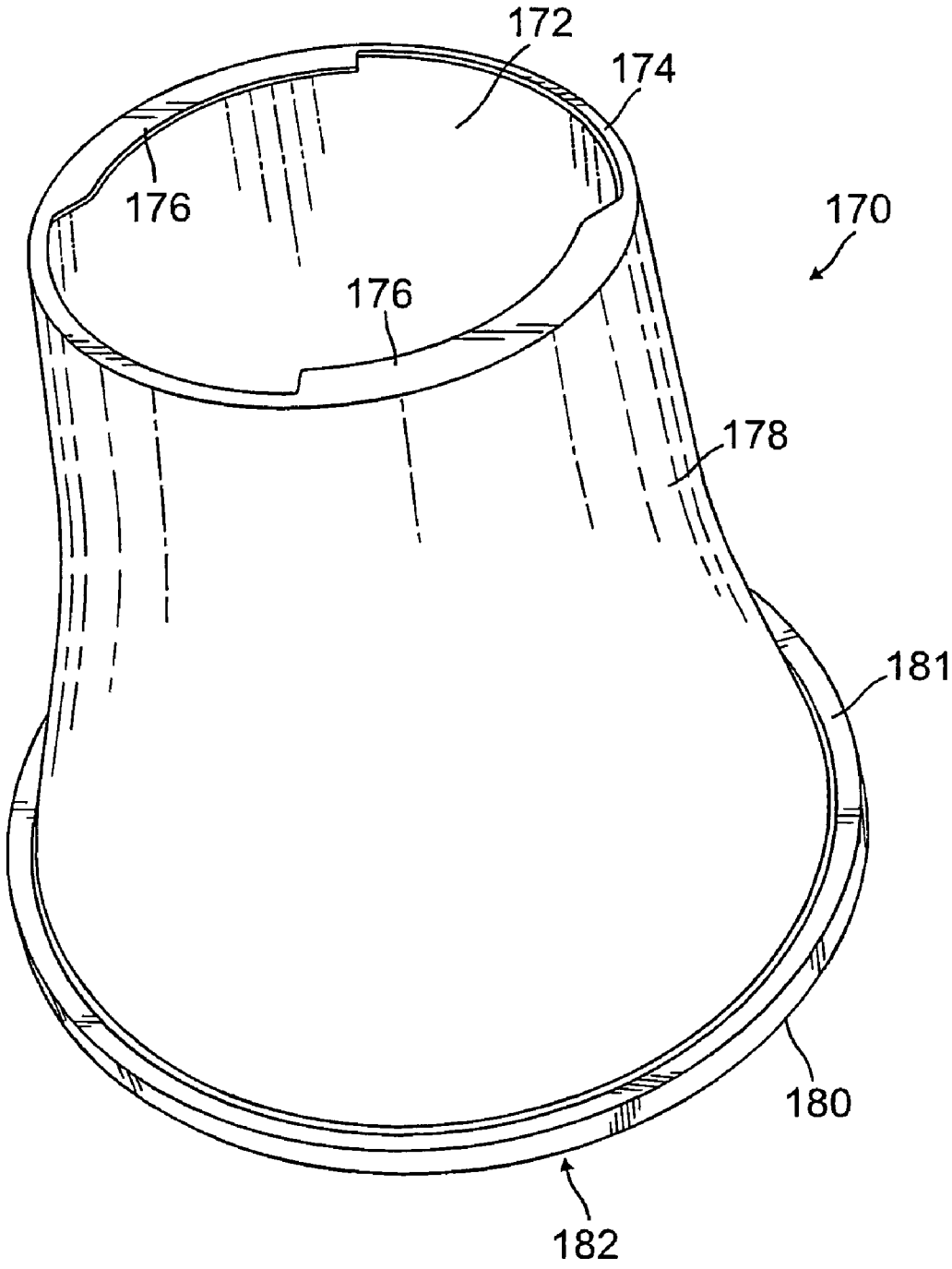
Figure 11A:
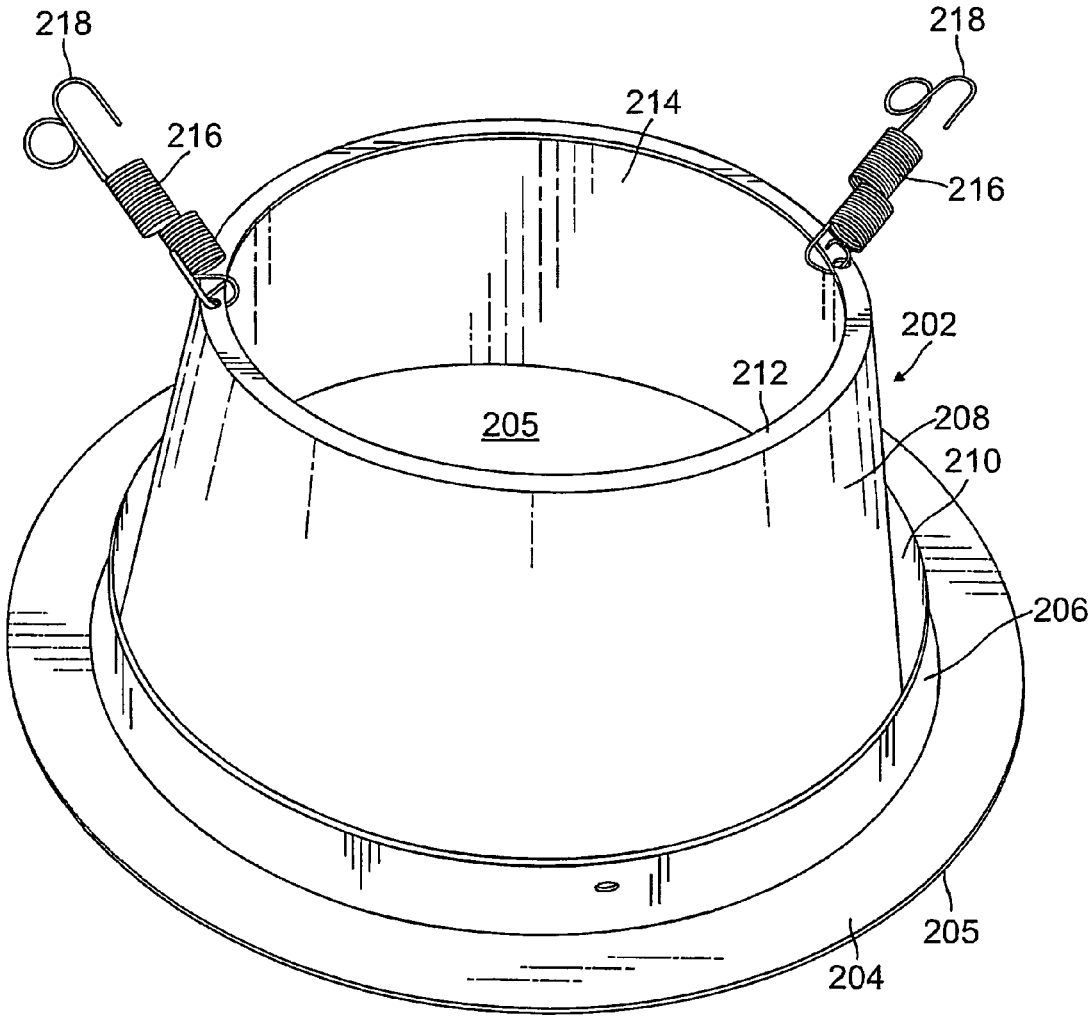
Figure 11B:
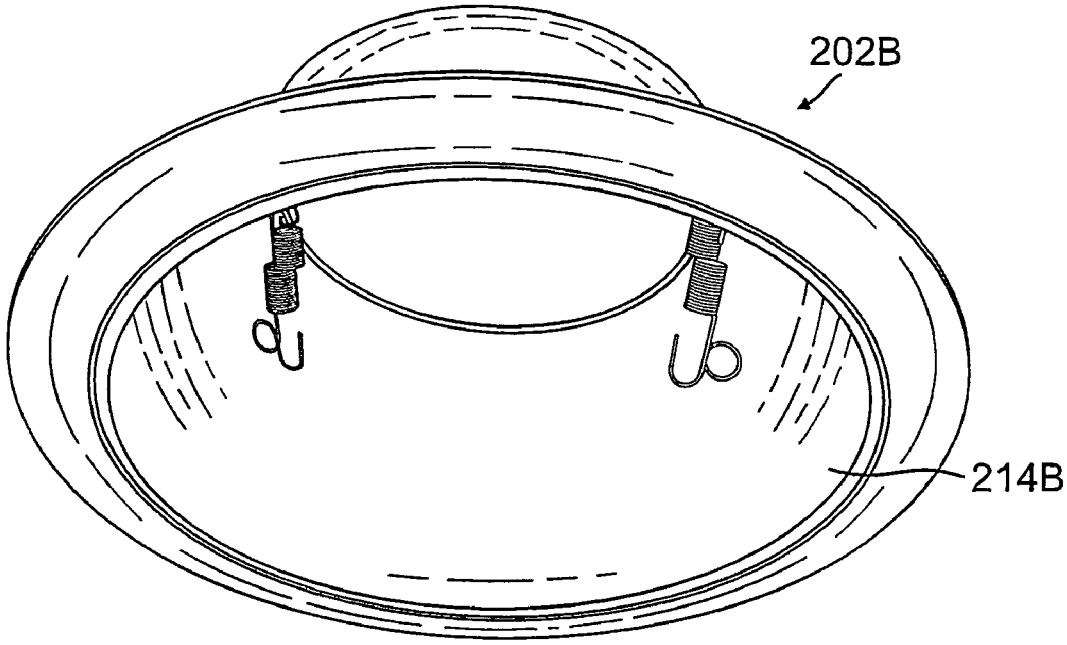
Figure 11C:
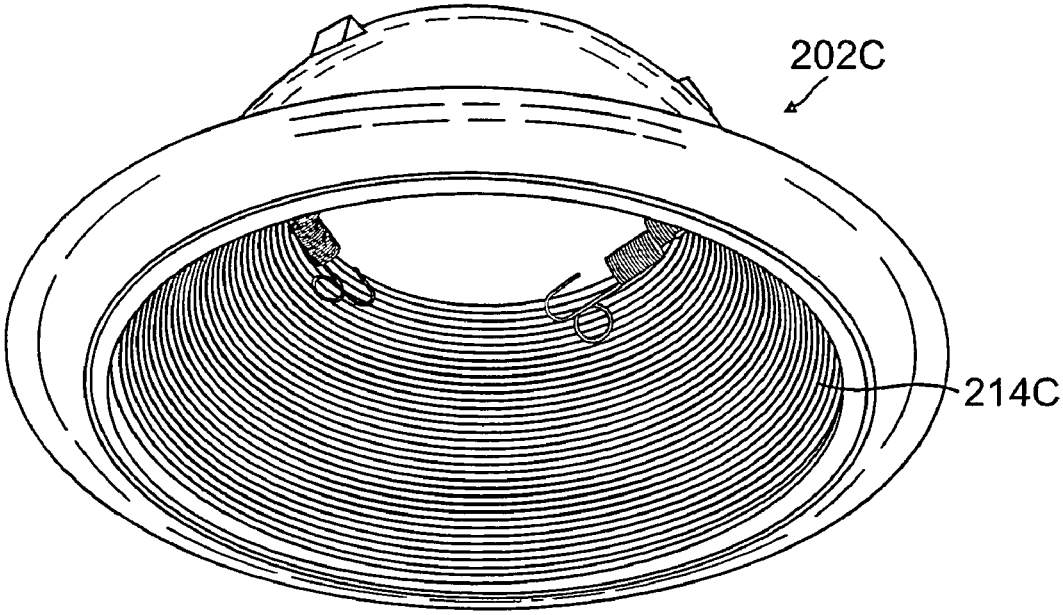
Figure 11D:
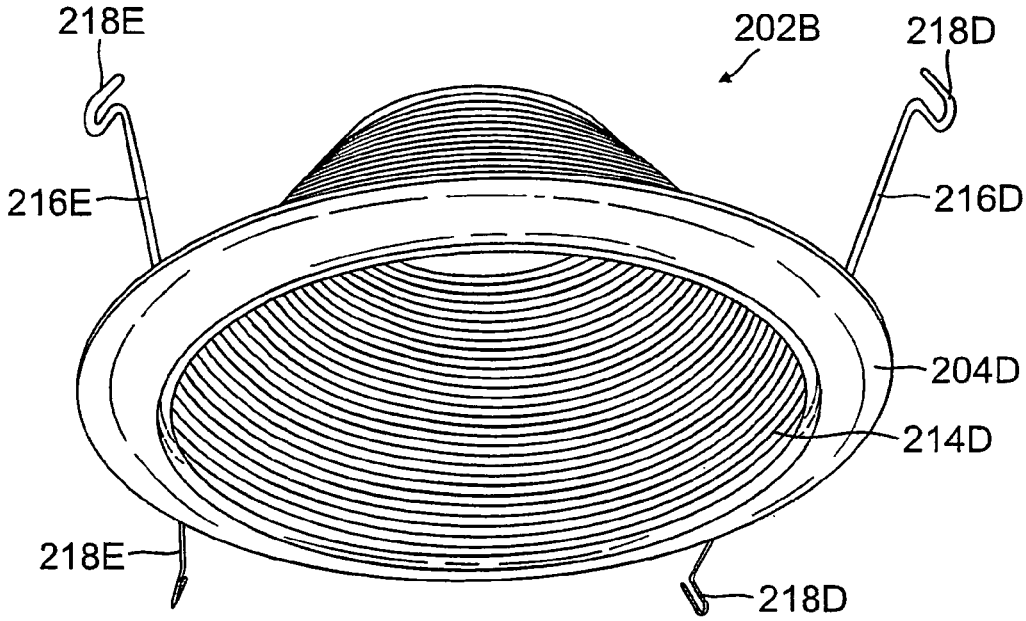
Figure 11E:
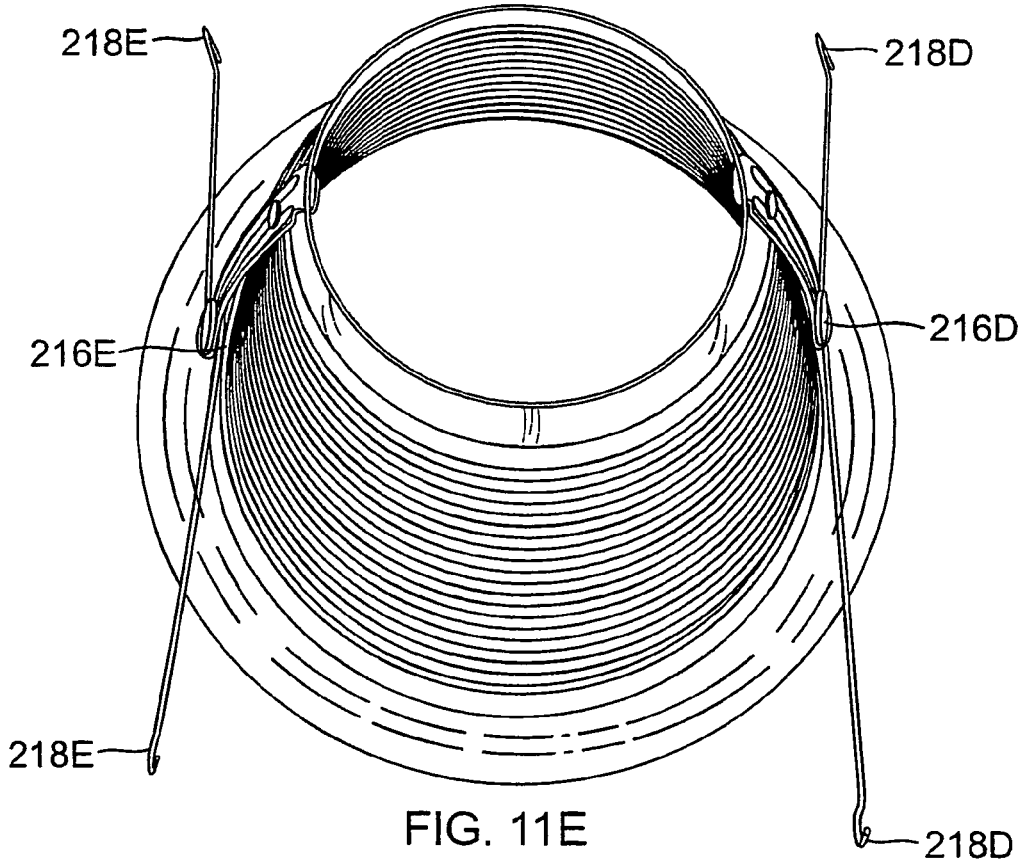
Figure 11F:
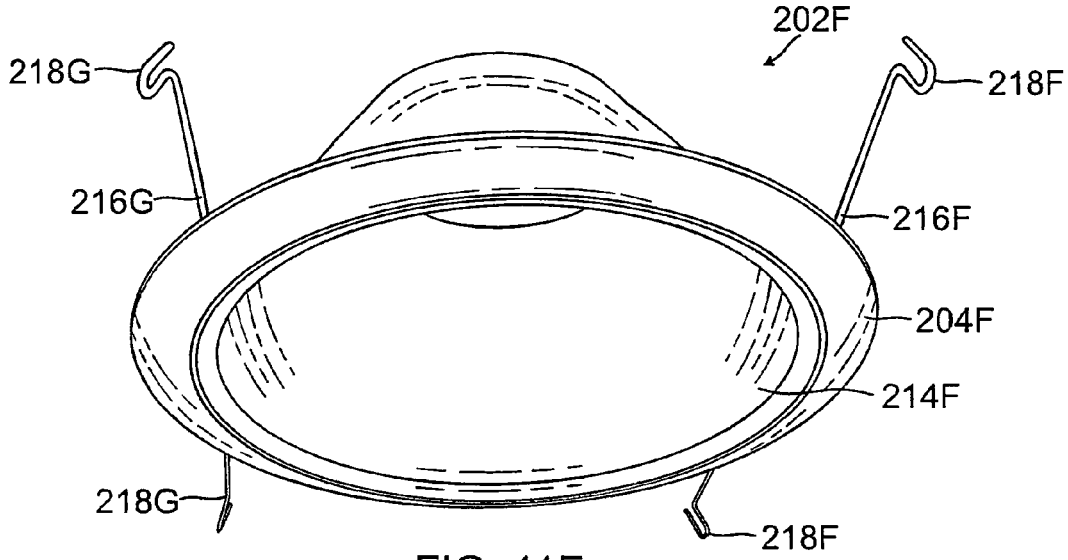
Figure 11G:
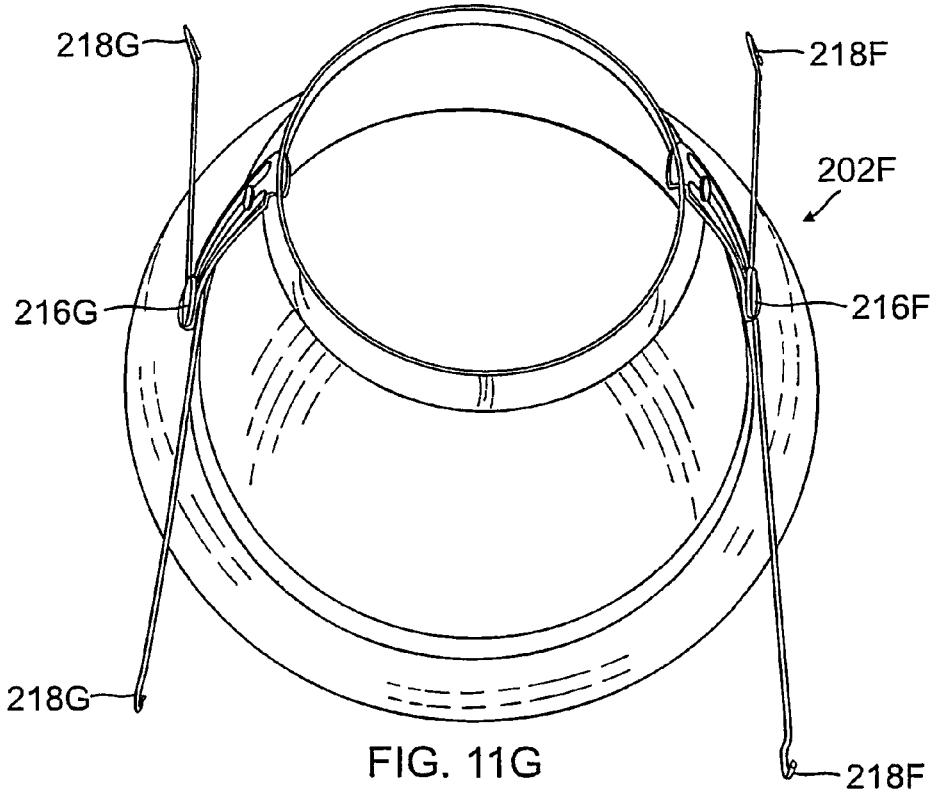
Figure 11H:
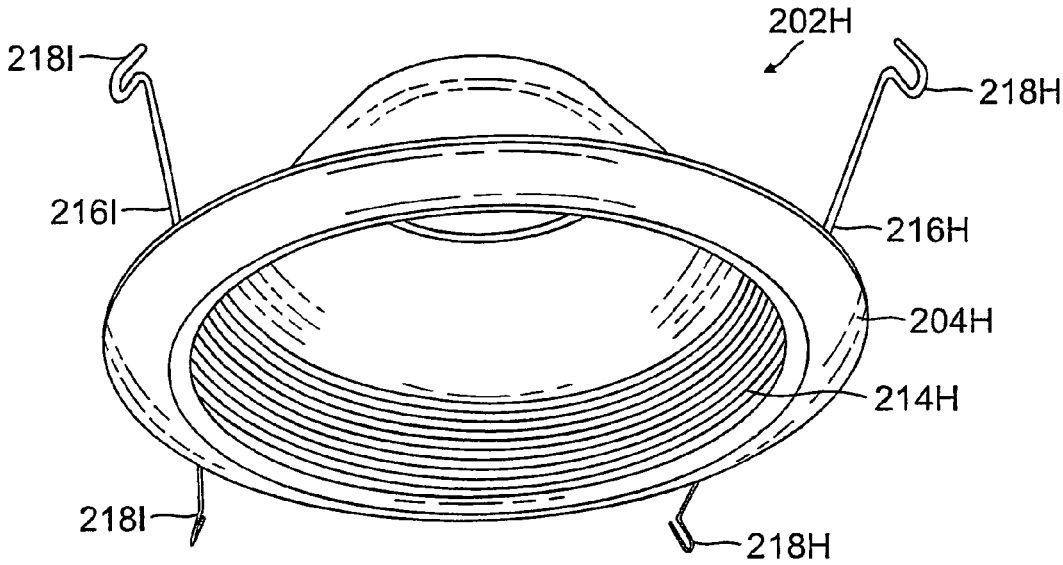
Figure 11I:
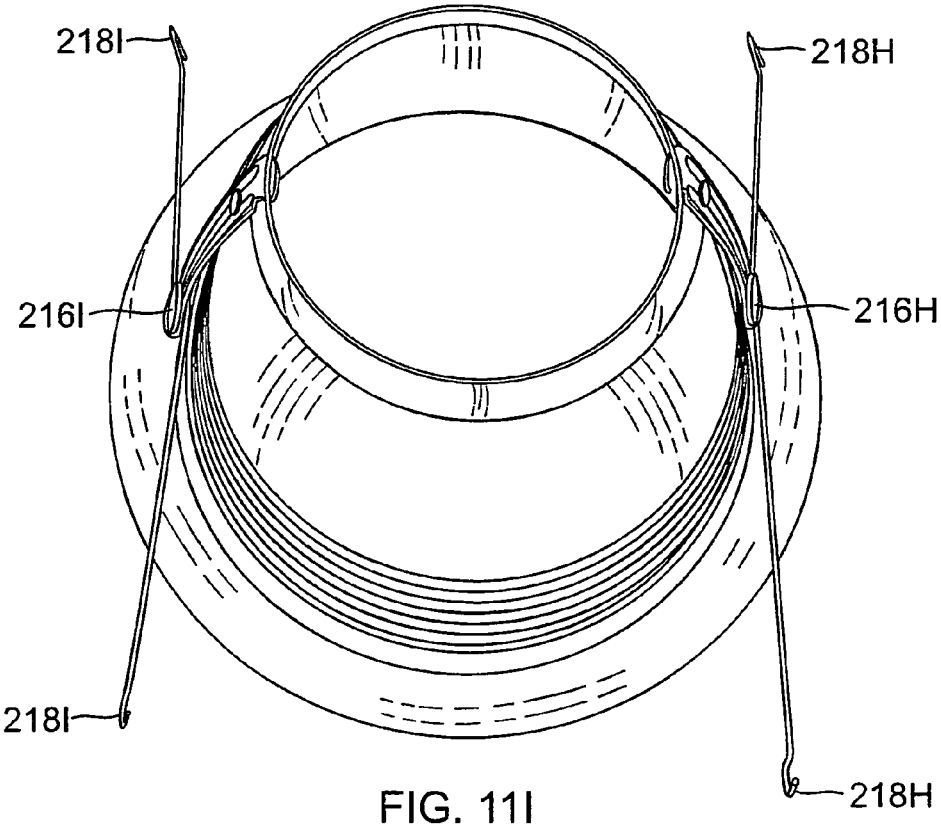
Figure 11J:
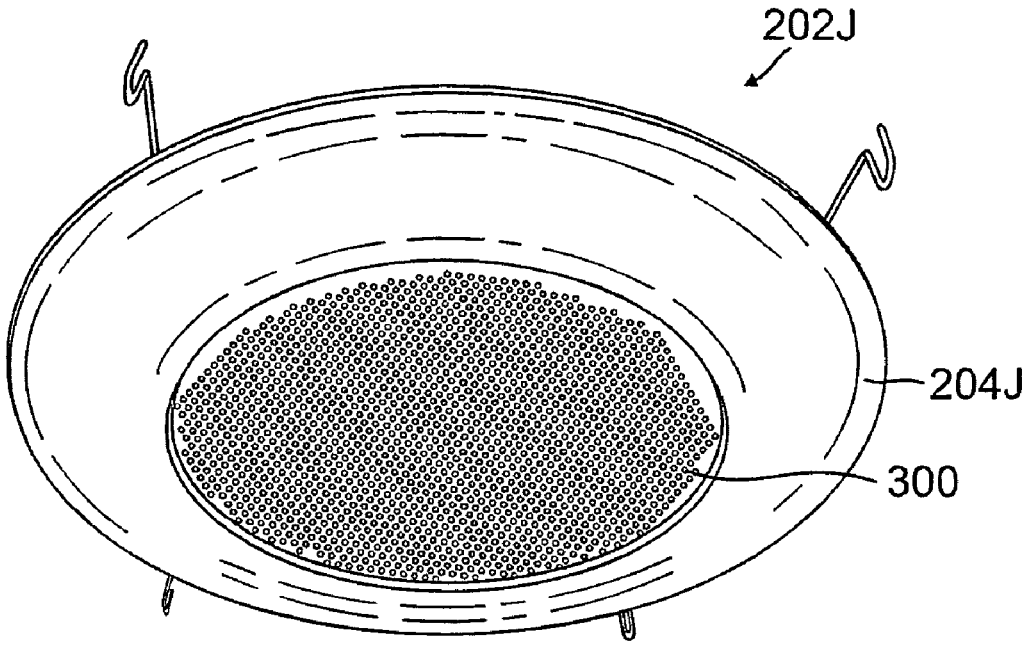
Figure 11K:
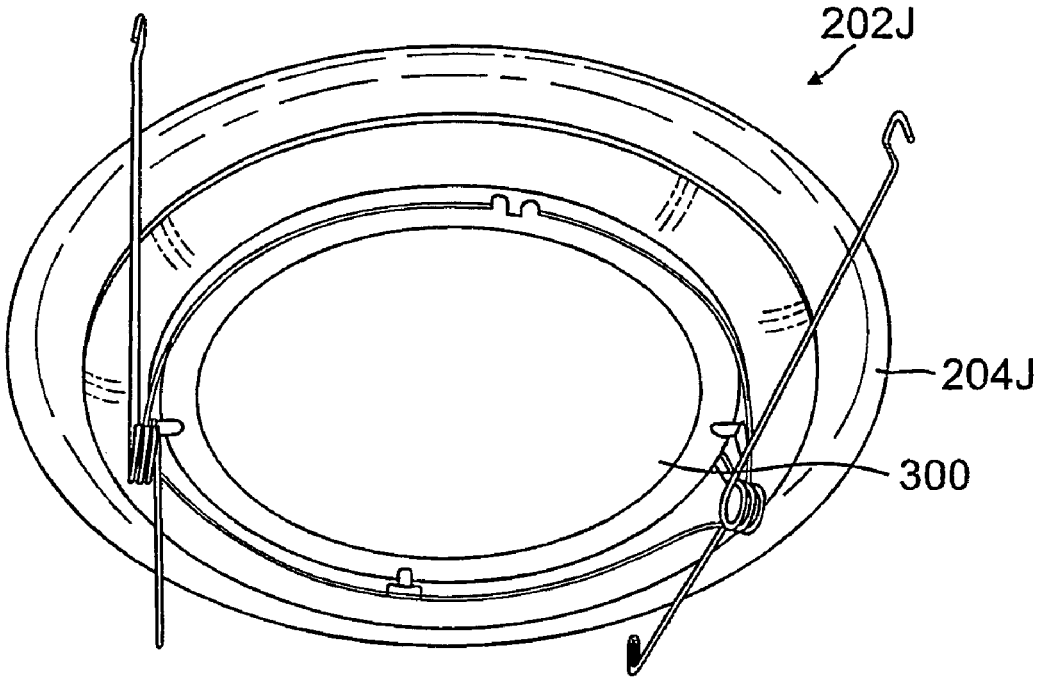
Figure 11L:
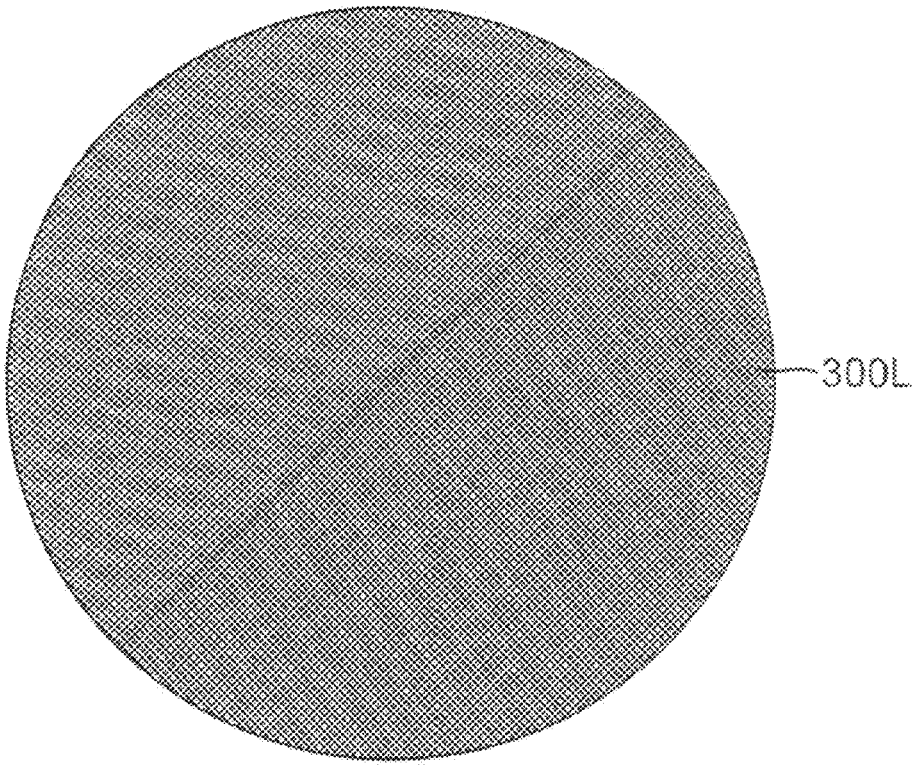
Figure 11M:
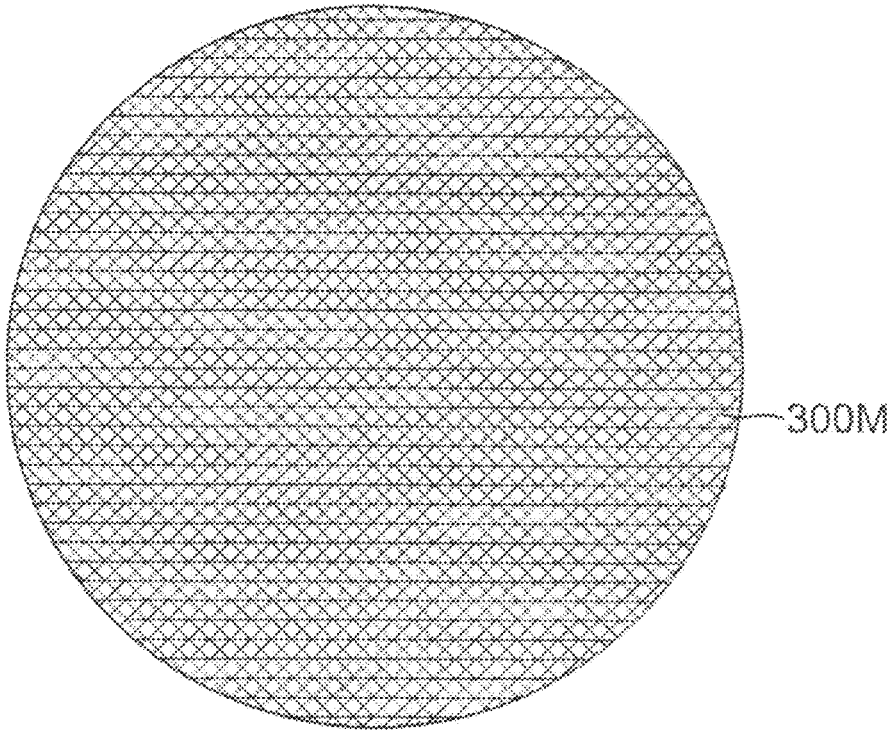
Figure 11N:
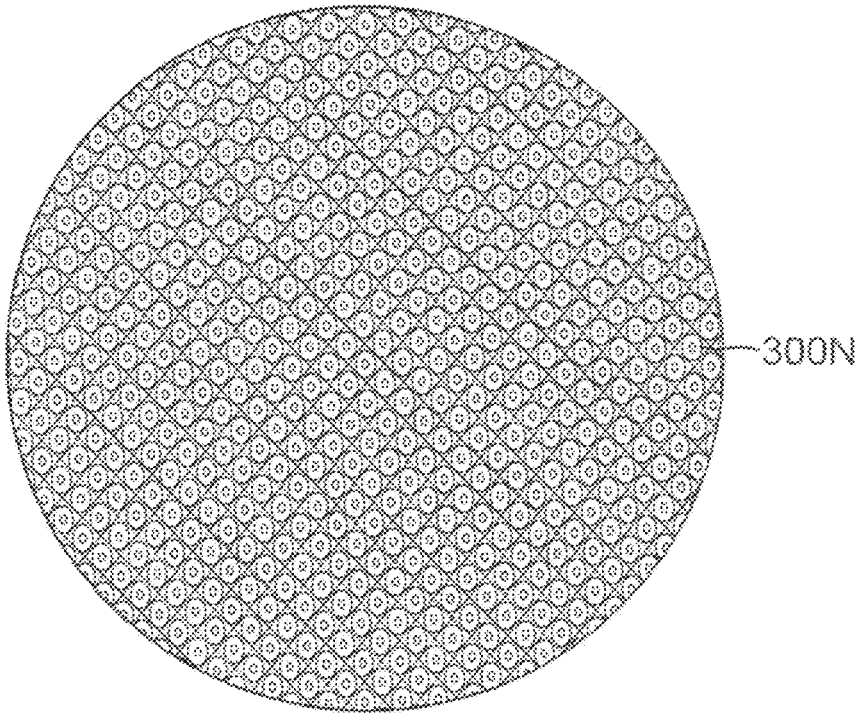
Figure 11O:
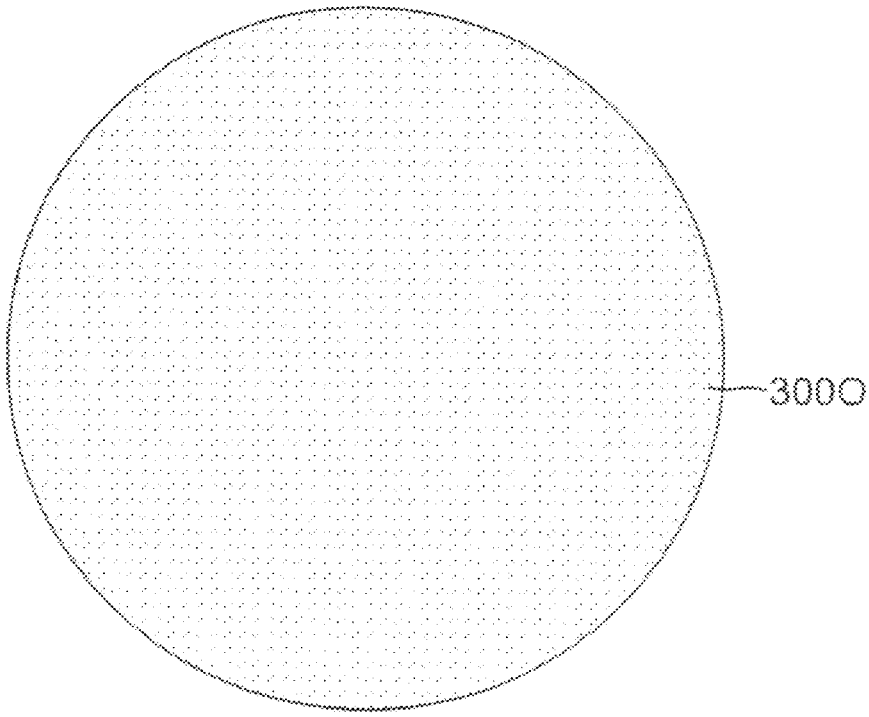
Figure 11P:
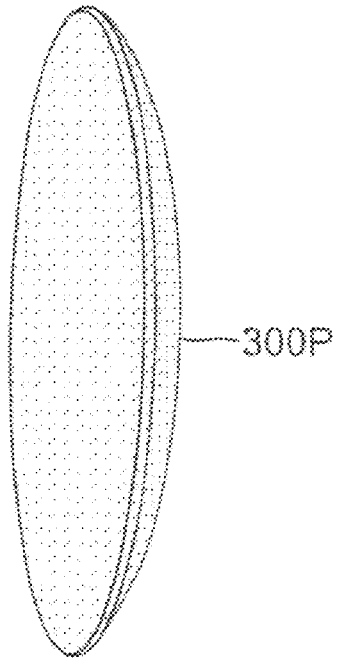
Figure 11Q:
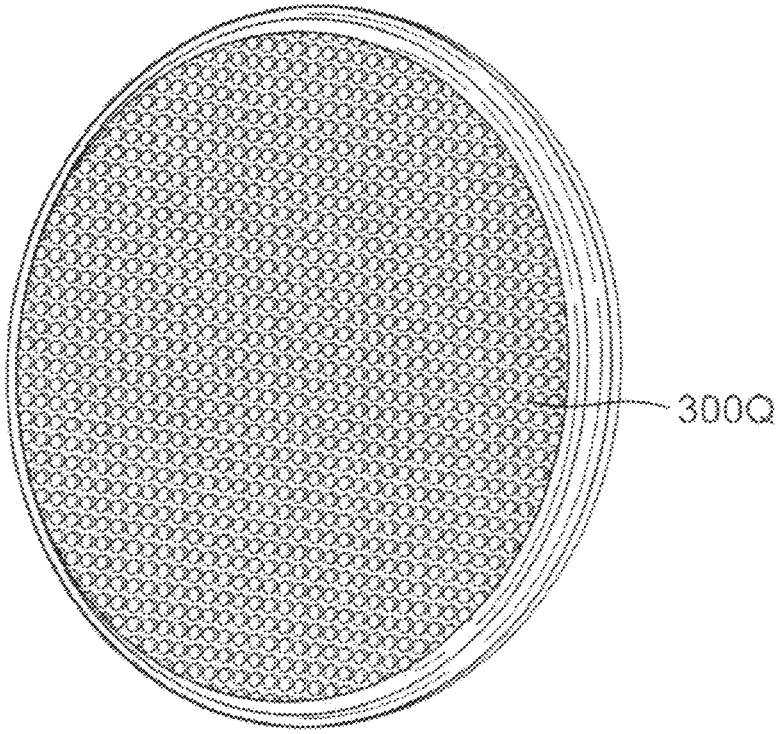
Figure 11R:
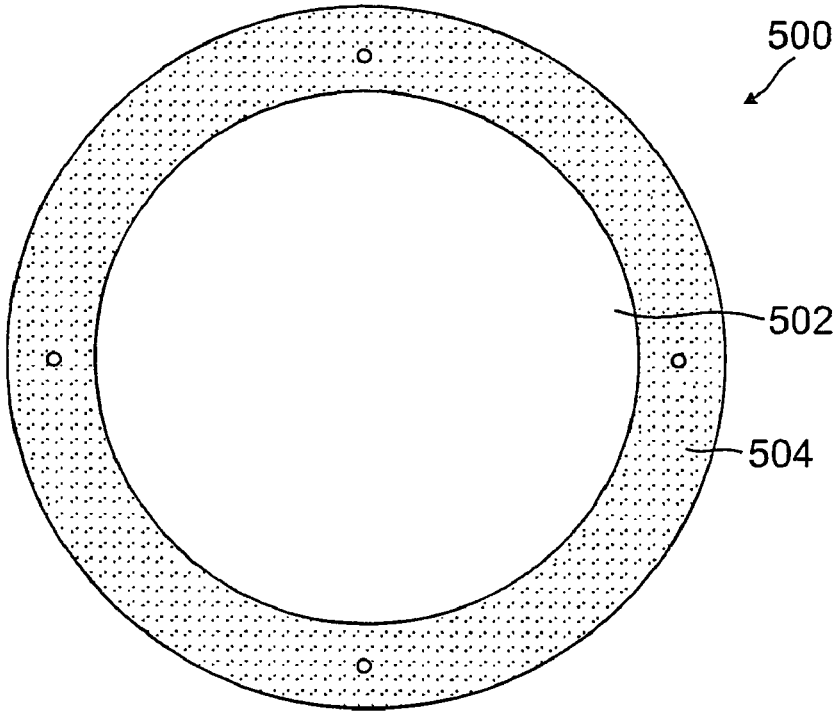
Figure 11S:
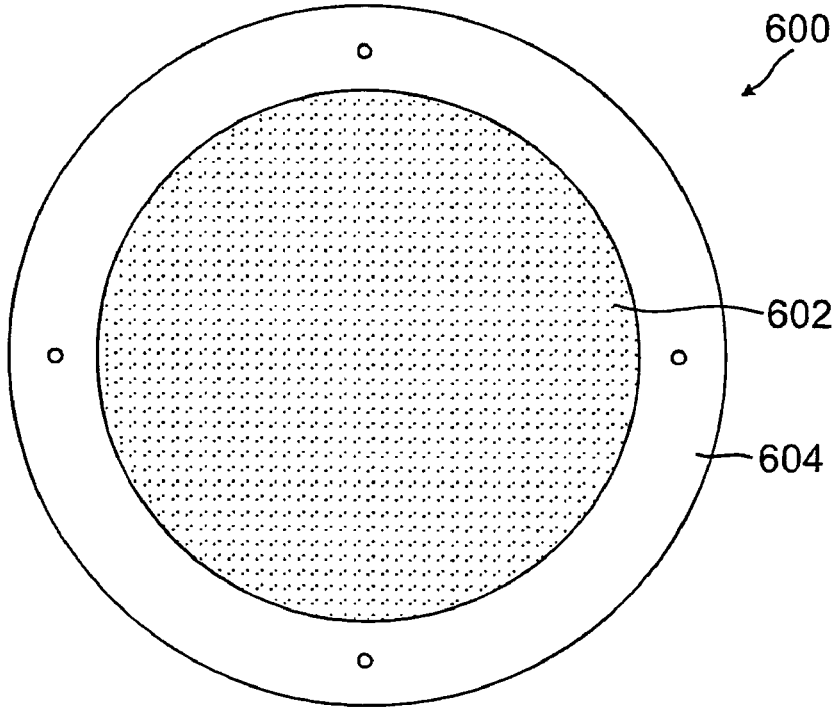
Figure 11T:
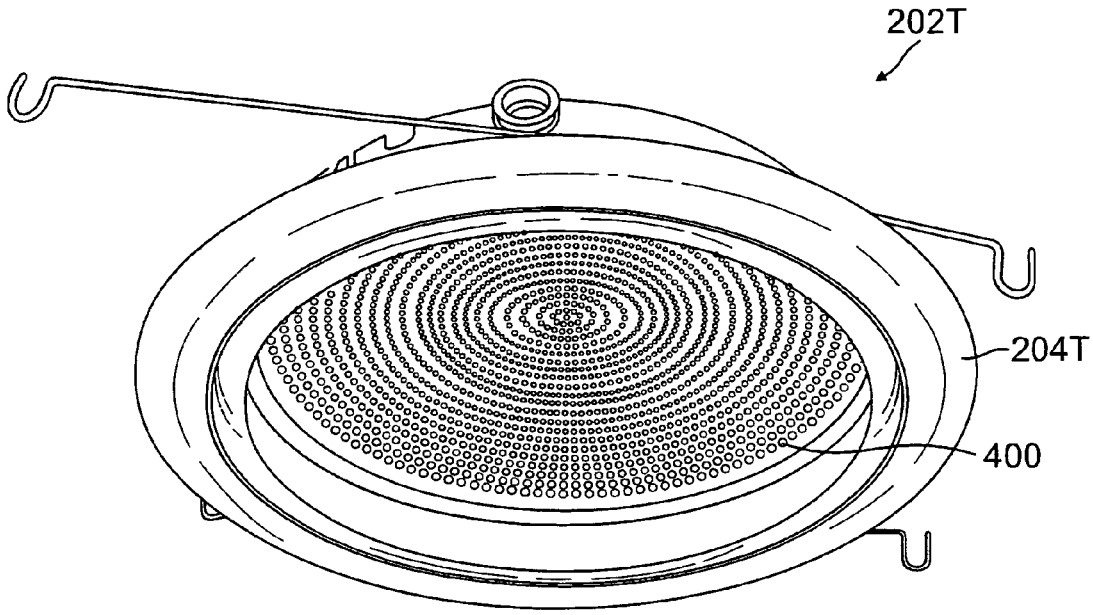
Figure 11U:
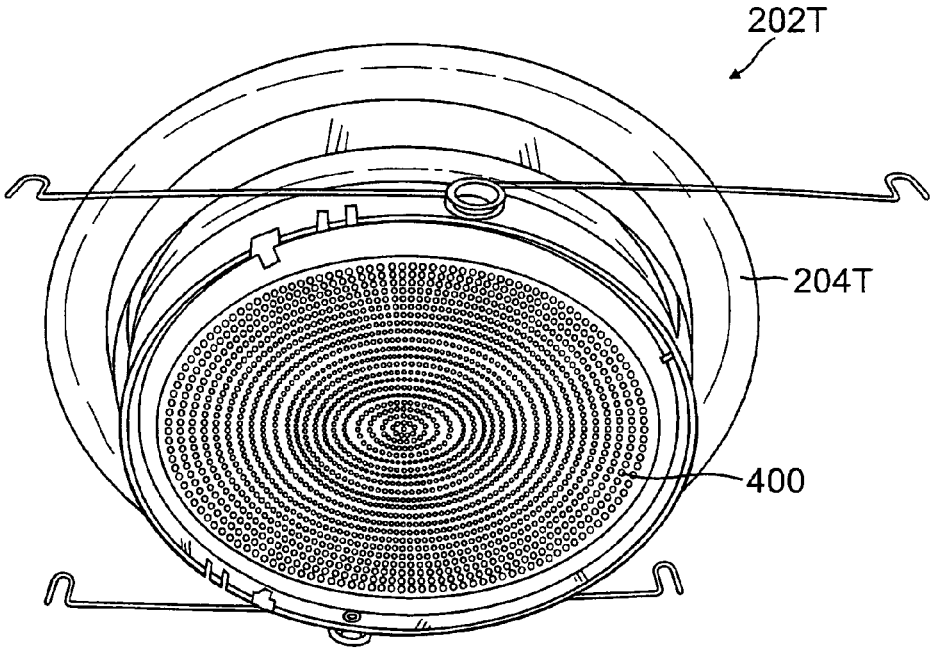
Figure 11V:
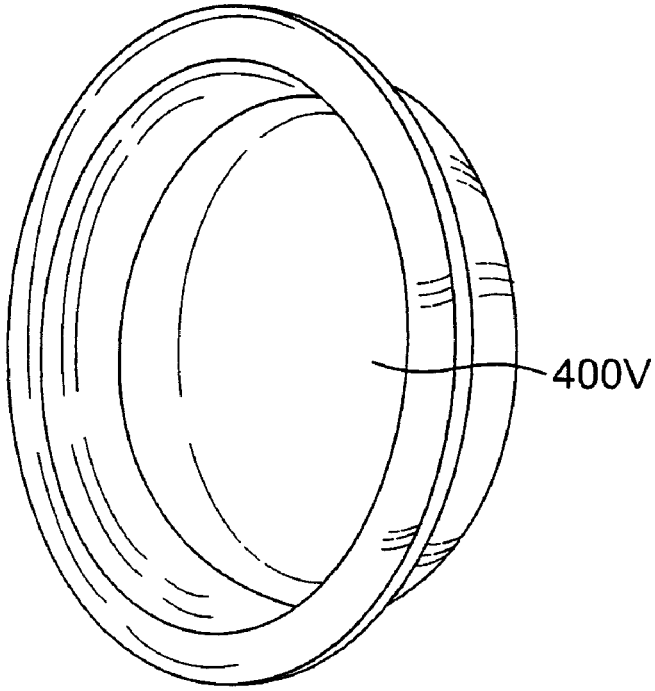
Figure 11W:
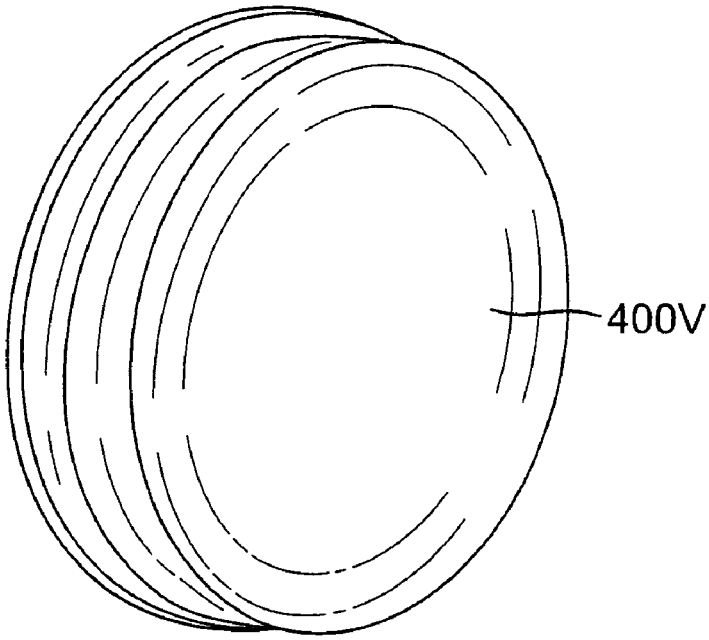
Figure 12:
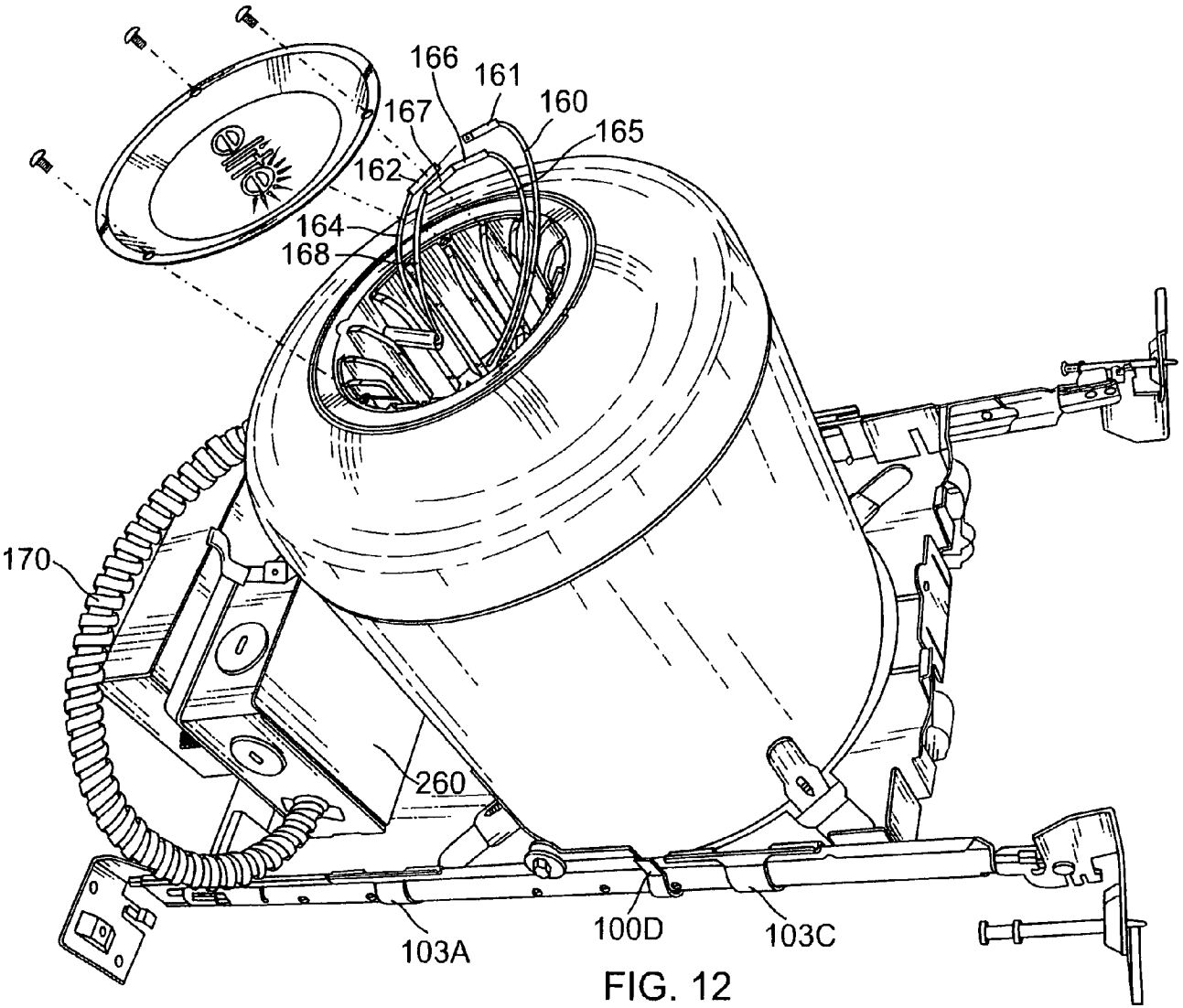
Figure 13:
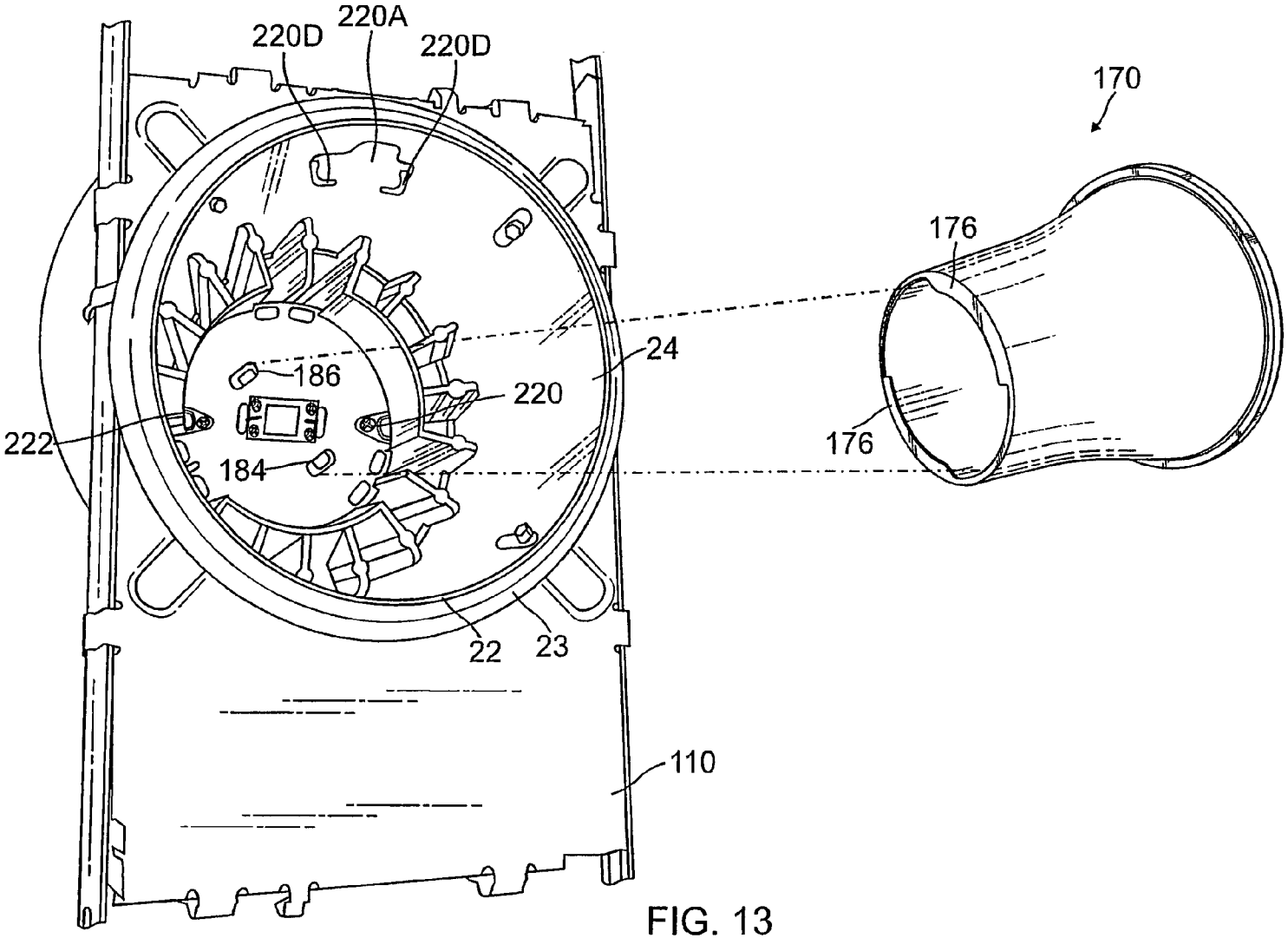
Figure 14A:
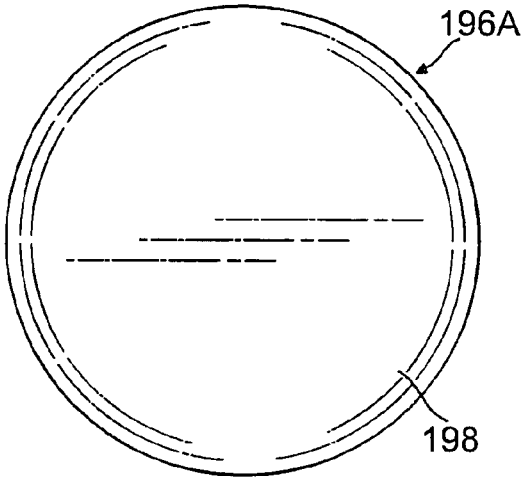
Figure 14B:
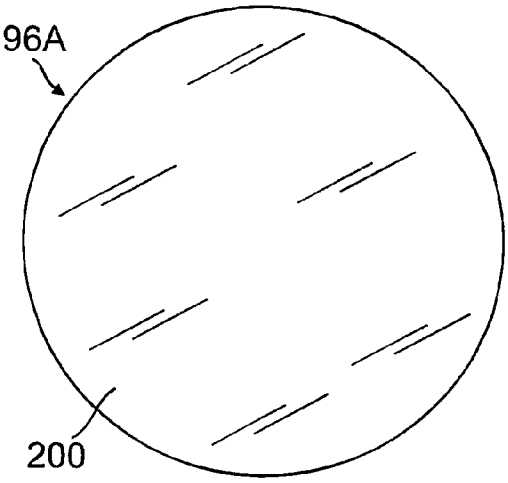
Figure 14C:
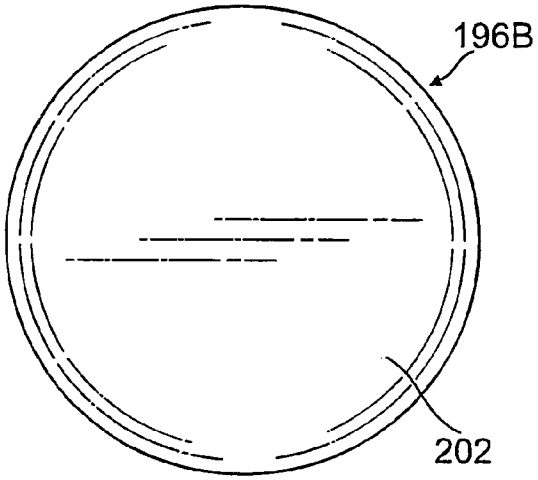
Figure 14D:
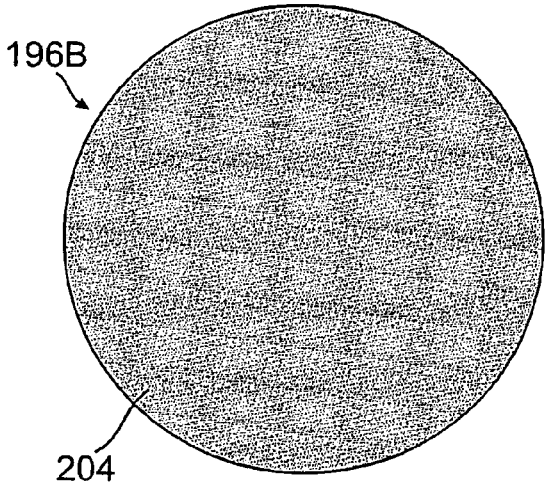
Figure 14E:
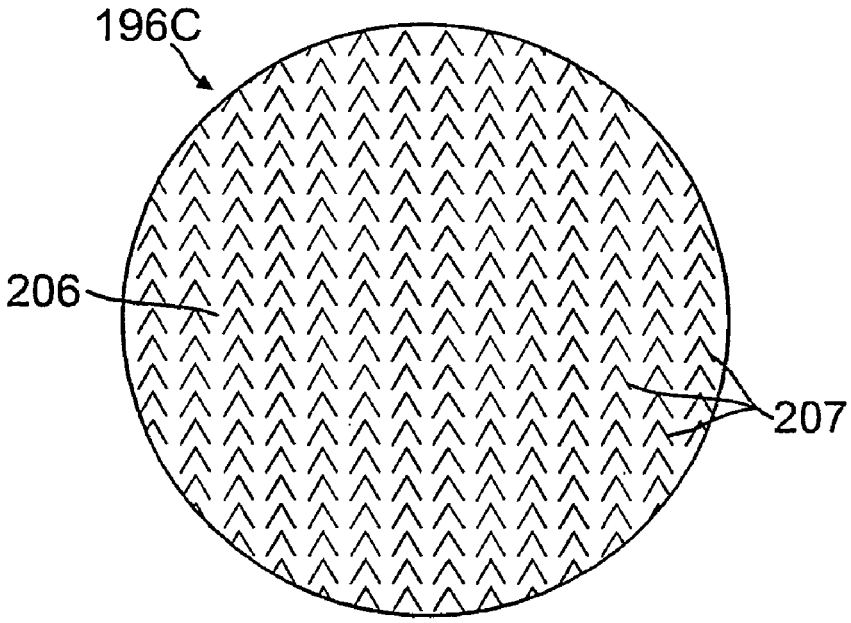
Figure 14F:
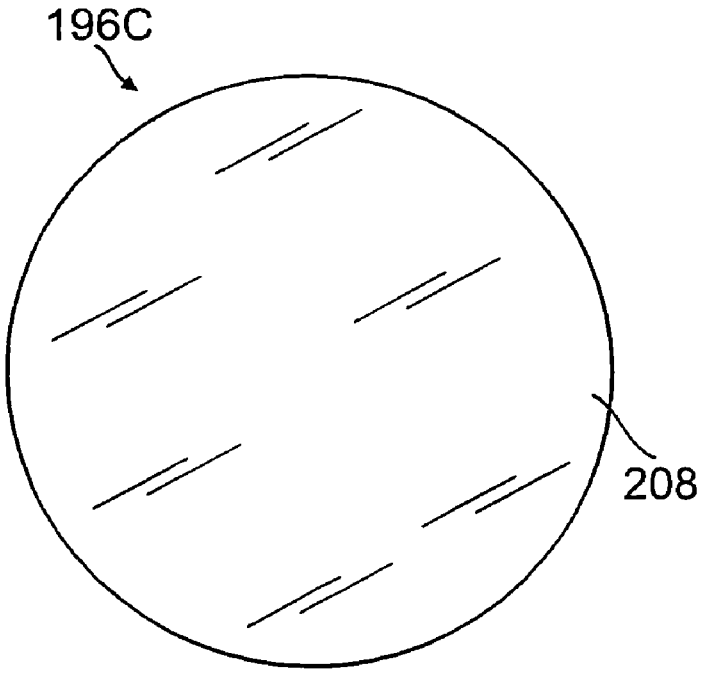

There is illustrated a front elevational view for various shapes of the light reflector of the present invention, wherein:

FIG. 9*a* illustrates a first embodiment of the light reflector having a circular concave exterior surface;

FIG. 9*b* illustrates a second embodiment of the light reflector having a circular convex exterior surface; and FIG. 9*c* illustrates a third embodiment of the light reflector having a frustum exterior surface;

FIG. 10 is a perspective view of the first embodiment of the light reflector having a circular concave exterior surface;

FIG. 11A is a bottom perspective view of one embodiment of the bottom trim ring cover of the present invention;

FIG. 11B is a top perspective view of the trim ring cover of FIG. 11A with a smooth reflective surface;

FIG. 11C is a top perspective view of the trim ring cover of FIG. 11A with a baffled reflective surface;

FIG. 11D is a top perspective view of an alternative embodiment of the bottom trim ring cover of the present invention having a baffled reflective surface;

FIG. 11E is a bottom perspective view of the alternative embodiment of the bottom trim ring cover of the present invention having a baffled reflective surface;

FIG. 11F is a top perspective view of the alternative embodiment of the bottom trim ring cover of the present invention having a smooth reflective surface;

FIG. 11G is a bottom perspective view of the alternative embodiment of the bottom trim ring cover of the present invention having a baffled reflective surface;

FIG. 11H is a top perspective view of the alternative embodiment of the bottom trim ring cover of the present invention having a reflective surface which is partially smooth and partially baffled;

FIG. 11I is a bottom perspective view of the alternative embodiment of the bottom trim ring cover of the present invention having a reflective surface which is partially smooth and partially baffled;

FIG. 11J is a top perspective view of the alternative embodiment of the bottom trim ring cover of the present invention retaining a flush mounted prismatic lens;

FIG. 11K is a bottom perspective view of the alternative embodiment of the bottom trim ring cover of the present invention retaining a flush mounted prismatic lens;

FIG. 11L is a front view of a clear prismatic lens;

FIG. 11M is a front view of a soft prismatic lens;

FIG. 11N is a front view of a plastic prismatic lens;

FIG. 11O is a front view of a sand blasted prismatic lens;

FIG. 11P is a front view of a modified magnifying prismatic lens;

FIG. 11Q is a front view of an opaque prismatic lens;

FIG. 11R is a front view of a lens with the center clear and the outer ring frosted;

FIG. 11S is a front view of a lens with the center frosted and the outer ring clear;

FIG. 11T is a top perspective view of the alternative embodiment of the bottom trim ring cover of the present invention retaining a recess fresnel lens;

FIG. 11U is a bottom perspective view of the alternative embodiment of the bottom trim ring cover of the present invention retaining a recessed fresnel lens;

FIG. 11V is a top perspective view of a recessed opaque lens;

FIG. 11W is a bottom perspective view of a recessed opaque lens;

FIG. 12 is an exploded perspective view of the present invention to illustrate that first and second single pole detachable connectors are positioned inside of the upper interior air gap chamber;

FIG. 13 is an exploded perspective view of the present invention to illustrate how the light reflector is affixed into inside of the canister but not show how it is affixed to the outside of the canister; and There are illustrated various embodiments of lens from the present invention, wherein:

FIG. 14A is a front plan view of the lens according to a first embodiment of the lens, wherein the front surface of the lens is frosted;

FIG. 14B is a rear plan view of the lens according to the first embodiment of the lens, wherein the rear surface of the lens is smooth;

FIG. 14C is a front plan view of the lens according to a second embodiment of the lens, wherein the front surface of the lens is frosted;

FIG. 14D is a rear plan view of the lens according to the second embodiment of the lens, wherein the rear surface of the lens is sanded;

FIG. 14E is a front plan view of the lens according to a third embodiment of the lens, wherein there is a plurality of evenly distributed raised prisms or spots throughout the surface extending perpendicularly away therefrom; and FIG. 14F is a rear plan view of the lens according to the third embodiment of the lens, wherein the rear surface of the lens is smooth or sanded.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
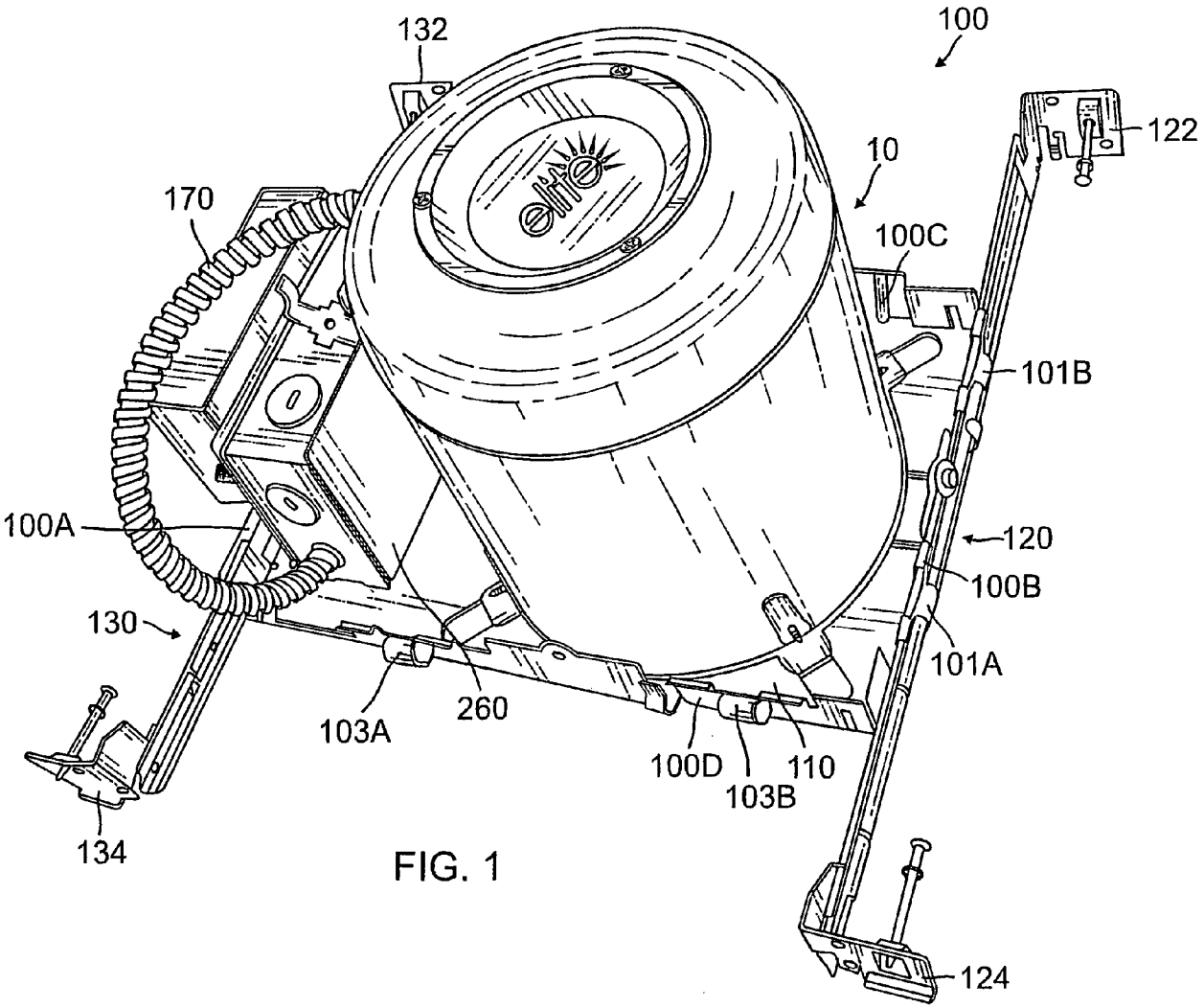
FIG. 1 is a side perspective view of the LED lighting luminaire with the improved canister of the present invention, where a pair of hanger bars are installed on the respective shorter sides of the mounting means.
Figure 2:
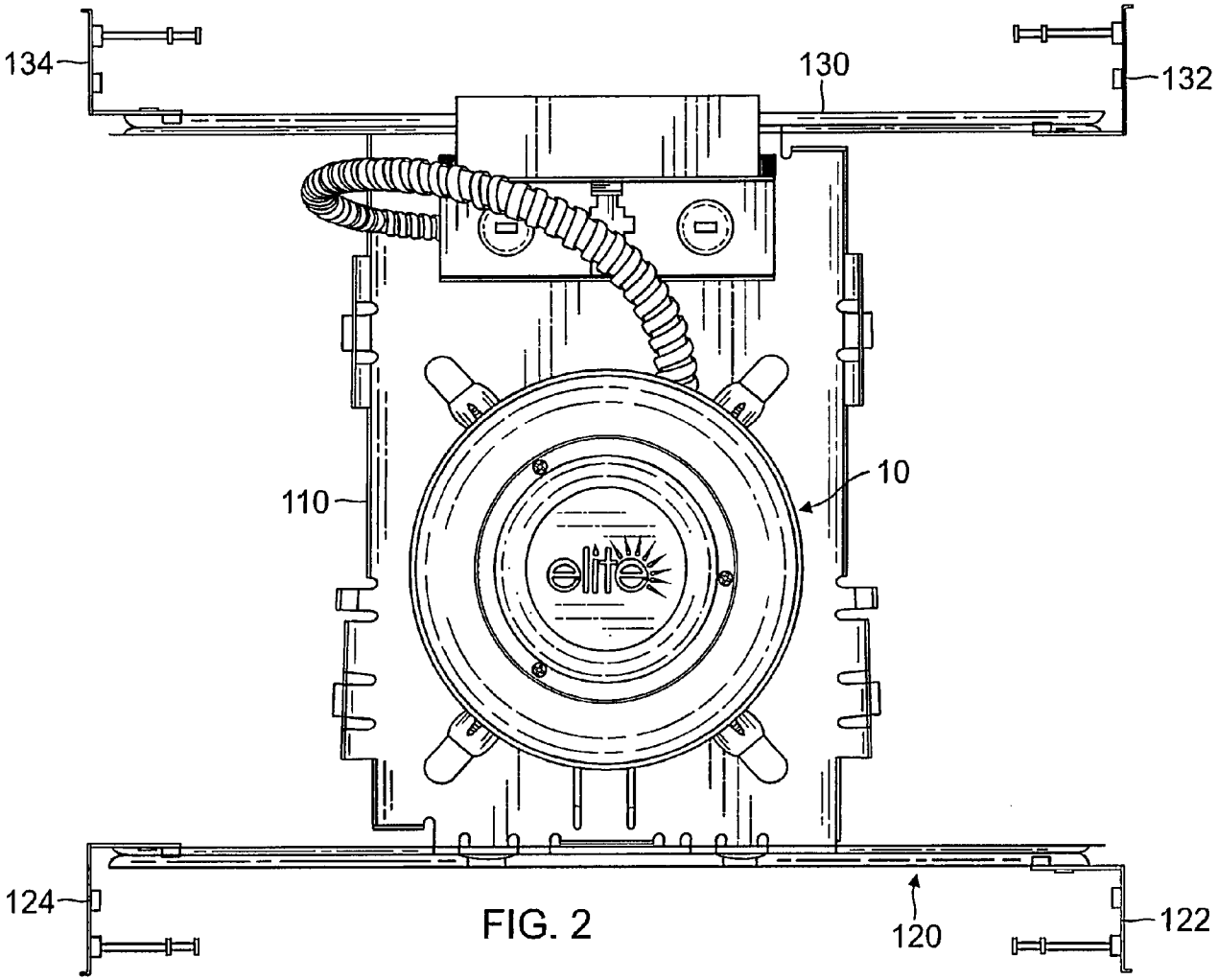
FIG. 2 is a top plan view of the LED lighting luminaire with the improved canister of the present invention.
Figure 3:
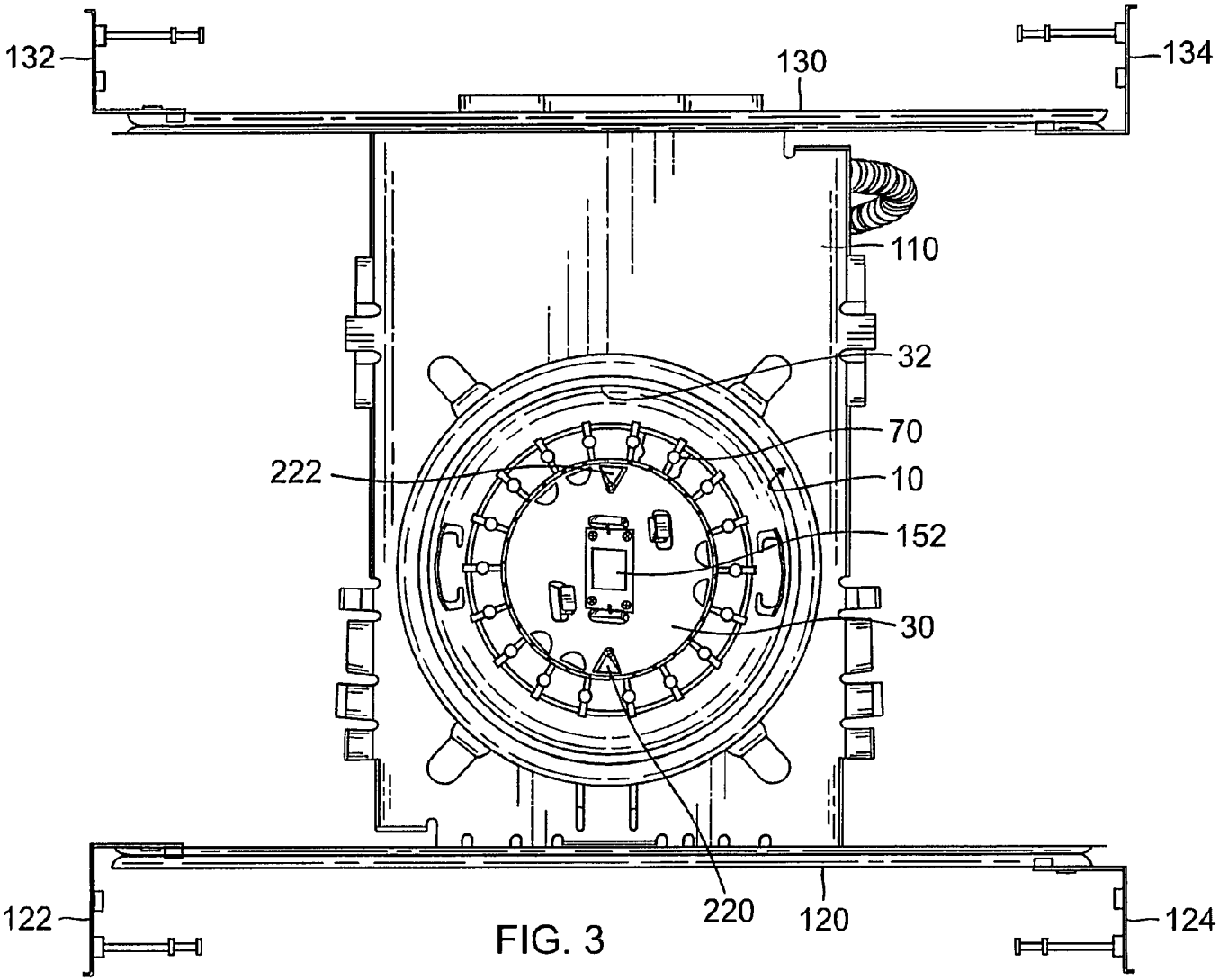
FIG. 3 is a bottom plan view of the LED lighting luminaire with the improved canister of the present invention.
Figure 4:
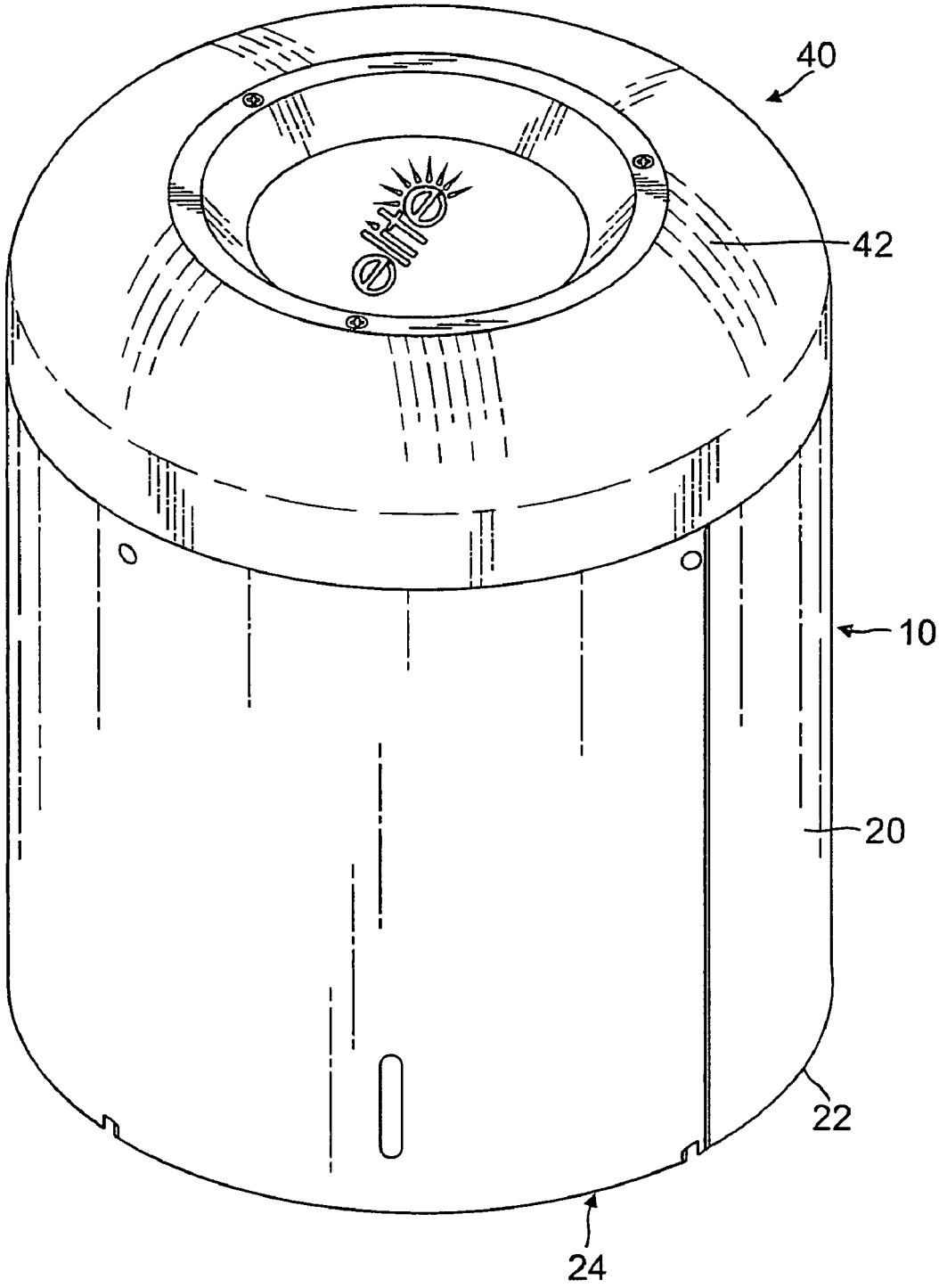
FIG. 4 is a perspective view of the improved canister of the present invention when viewed from the outside.

Referring to FIGS. 1 to 3, there is illustrated the present invention improved heat dissipation veins or fins and recessed cap in the canister 10 of a lighting luminaire assembly 100. The canister 10 is retained on a mounting fixture 110 which includes a pair of oppositely disposed hanger bar assemblies 120 and 130 with mounting brackets 122, 124, 132 and 134 by which the lighting luminaire assembly 100 is mounted between studs or beams in the ceiling of a structure. The housing for the electrical components 260 is also illustrated. The lighting luminaire assembly is shown for illustrative purposes only and the present invention improved canister can be incorporated into any multiplicity of lighting luminaire assemblies.

Figure 8:
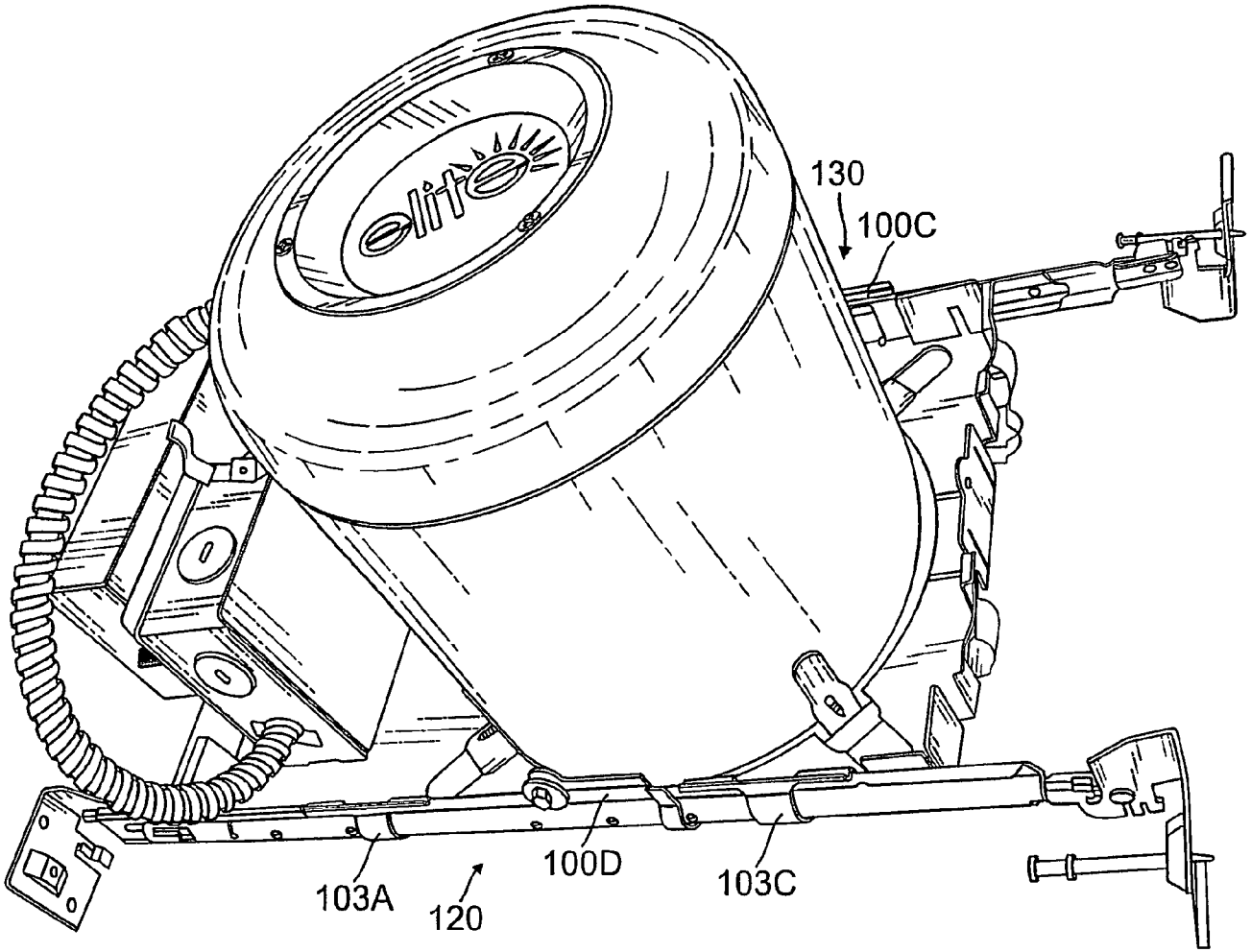
FIG. 8 is a side perspective view of the LED lighting luminaire with the improved canister of the present invention, where a pair of hanger bars are installed on the respective longer sides of the mounting means as compared with installation of the hanger bars in FIG. 1.

Referring to FIGS. 1 and 8, one significant improvement is the incorporation of hanger bar retaining members on the short sides 100A and 100B of the mounting fixture 100 and also bar hanger retaining members on the long sides 100C and 100D of the mounting fixture 100. On the short side, bar hanger retaining members 101A and 101B are illustrated on short side 100B. It will be appreciated that corresponding bar hanger retaining members are on short side 100A. FIG. 1 illustrates the bar hanger assemblies 120 and 130 retained on the short sides of the mounting fixture 100. On the long side, bar hanger retaining members 103A and 103B are illustrated on long side 100D. It will be appreciated that corresponding bar hanger retaining members are on long side 100C. FIG. 8 illustrates the bar hanger assemblies 120 and 130 retained on the long sides of the mounting fixture 100. This unique feature enables maximum utilization of the mounting fixture which enables the bar hanger mounting brackets to be affixed to beams to fit a long opening (as illustrated in FIGS. 8 and 12) or to beams to fit a short opening (as illustrated in FIG. 1) in a ceiling.

Referring additionally to FIGS. 3-7, the lighting luminaire canister 10 is a generally cylindrical structure having a cylindrical sidewall 20 which includes a bottom circumference 22 of a circular bottom end that surrounds a bottom opening 24. The cylindrical sidewall 20 surrounds an interior chamber 30 (see FIG. 3) which houses an illumination means 150 such as an LED lamp, an incandescent lightbulb, or other illumination means including a reflector having baffles and trim which are attached in place by various attachment means which are removably attached at a location on the interior sidewall. Regardless of the illumination means, the illumination means gives off heat.

The top of the canister 10 is enclosed by a domed cover 40 having a contoured top surface 42, which is affixed to the sidewall 20 of the canister 10, wherein the contoured top surface 42 maximizes and facilitates air flow. In addition, the domed cover 40 is made of heavy cast aluminum and is designed to have a large radius and intimate contact with the sidewall 20 of the canister which design maximizes the surface areas of the canister for efficient heat dissipation. It will be appreciated that such structural characteristics are significant improvements as compared with conventional canisters where the domed cover is made of lightweight aluminum and usually does not have a removable sealing cap. Furthermore if there is a sealing cap in the conventional canisters, it is usually flat across the top of the domed cover.

An improvement of the present invention is to modify the removable sealing cap by having a sealing cap 50 recessed into the upper interior heat dissipation chamber 108 of interior chamber 30. In one embodiment, the cover 40 has a circumferential interior shelf 44 having a multiplicity of spaced apart threaded female receiving openings 44A, 44B and 44C. In one embodiment, the sealing cap 50 has a circumferential rim 52 with a multiplicity of openings 54A, 54B and 54C, which extend through the rim 52 and are respectively aligned with the multiplicity of threaded receiving openings 44A, 44B and 44C in the interior shelf 42 of the cover 40.

The sealing cap 50 has a downwardly extending sidewall 56 which terminates in a flat surface section 58. The sidewall is shown extending at an angle relative to the flat surface section 58 and circumferential rim 52. The sealing cap 50 is attached to the interior shelf 44 of the cover 40 by affixation means such as threaded bolts 53A, 53B and 53C which respectively extend through openings 54A, 54B and 54C and are respectively threaded into threaded receiving openings 44A, 44B and 44C. The sealing cap 50 is therefore recessed into the upper heat dissipation chamber 108 of the interior chamber 30 of the canister 10. It will be appreciated that the specific shape and means of attaching the sealing cap 50 are not limited to the embodiment illustrated and it is within the spirit and scope of the present invention to have a sealing cap of any shape and affixation means as long as the sealing cap is recessed and extends into the interior chamber of the canister.

The sealing cap is generally frustum shaped and extends into the interior chamber to thereby provide a greater surface area for the heat to dissipate as opposed to the prior art which the sealing cap is just flat across the top. Therefore, the fact that it is frustum in shape and extends into the interior chamber gives it an additional surface area adjacent the heat dissipation fins to enable the heat to dissipate more rapidly out of the canister. If the sealing cap were just flat then the air would stagnate on the top. But the fact that it is frustum in shape and is arched and curved enables the air to flow better out of the canister and not just stagnate across the top. California Title 24 of the Lighting Installation Requirement requires that when the recessed fixture is installed into the ceiling that it be air-tight and that the air that is within the canister in the controlled space not extend out of the canister into the uncontrolled space in the ceiling area above where the canister is installed. If the sealing cap where flat across the top the air would extend out of the top of the canister and into the uncontrolled space in violation of California Title 24. By having the recessed frustum shaped sealing cap it retains the heat within the canister and the heat does not go outside the canister and therefore it makes it Title 24 compliant.

Figure 5:
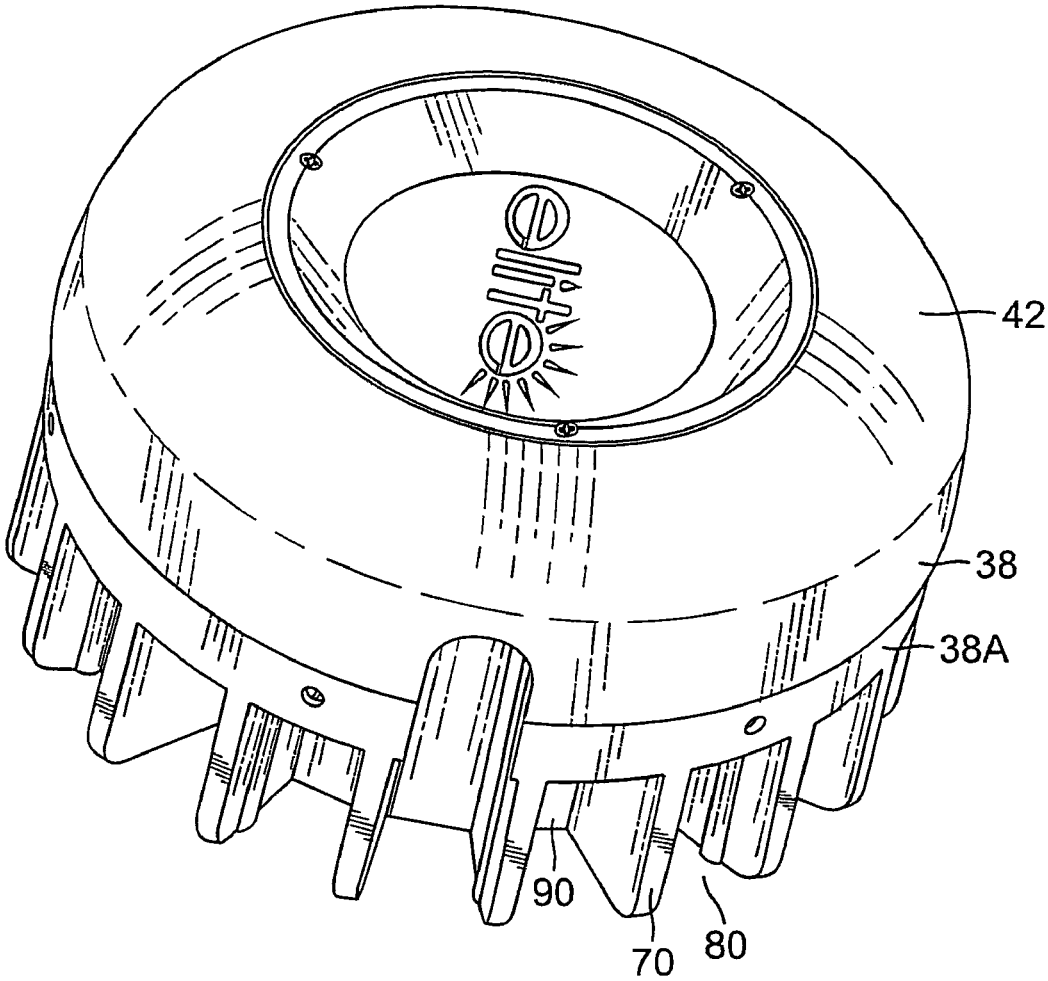
FIG. 5 is a side perspective view of the top of the canister removed from the remainder of the canister, illustrating the improved heat dissipating veins incorporated into the interior of the top of the canister.
Figure 6:
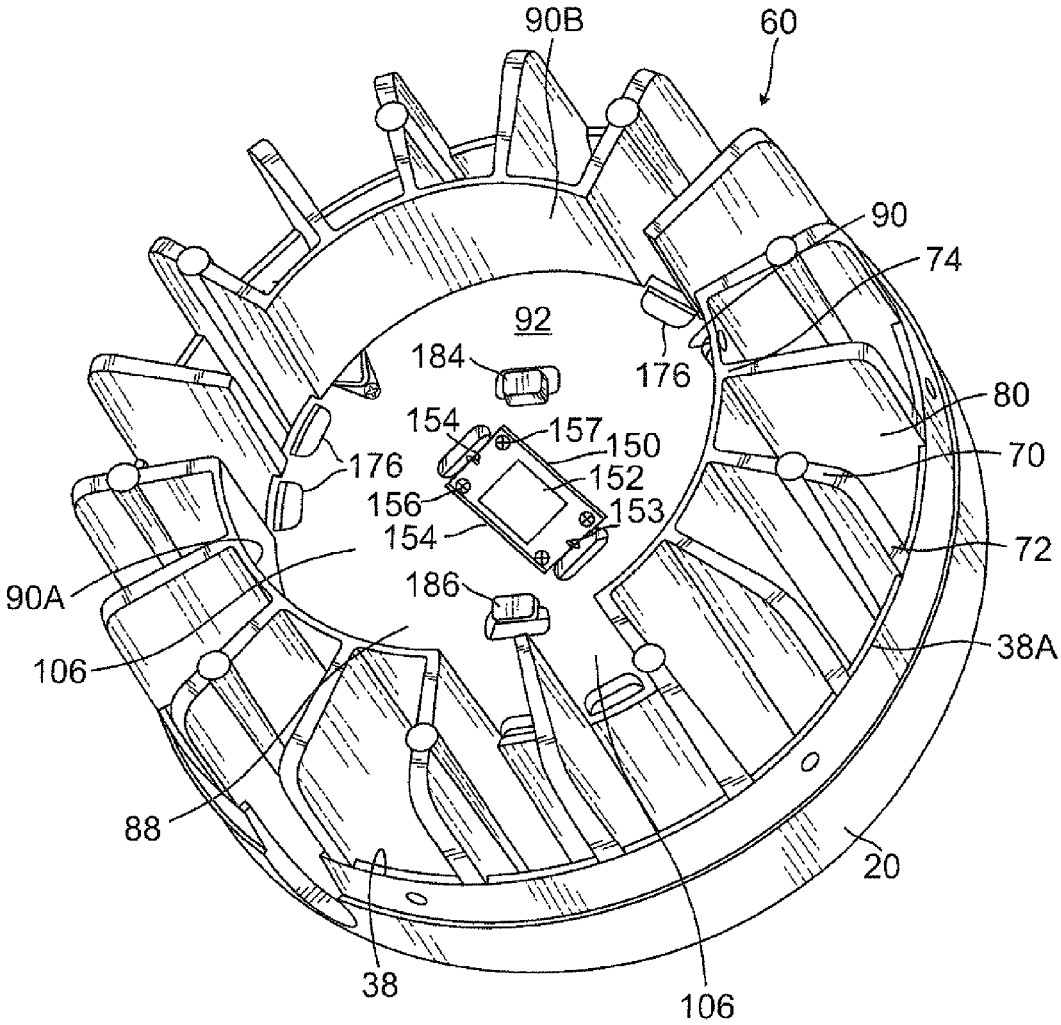
FIG. 6 is a bottom perspective view of the top of the canister removed from the remainder of the canister, illustrating the improved heat dissipating veins or fins incorporated into the interior of the top of the canister.
Figure 7:
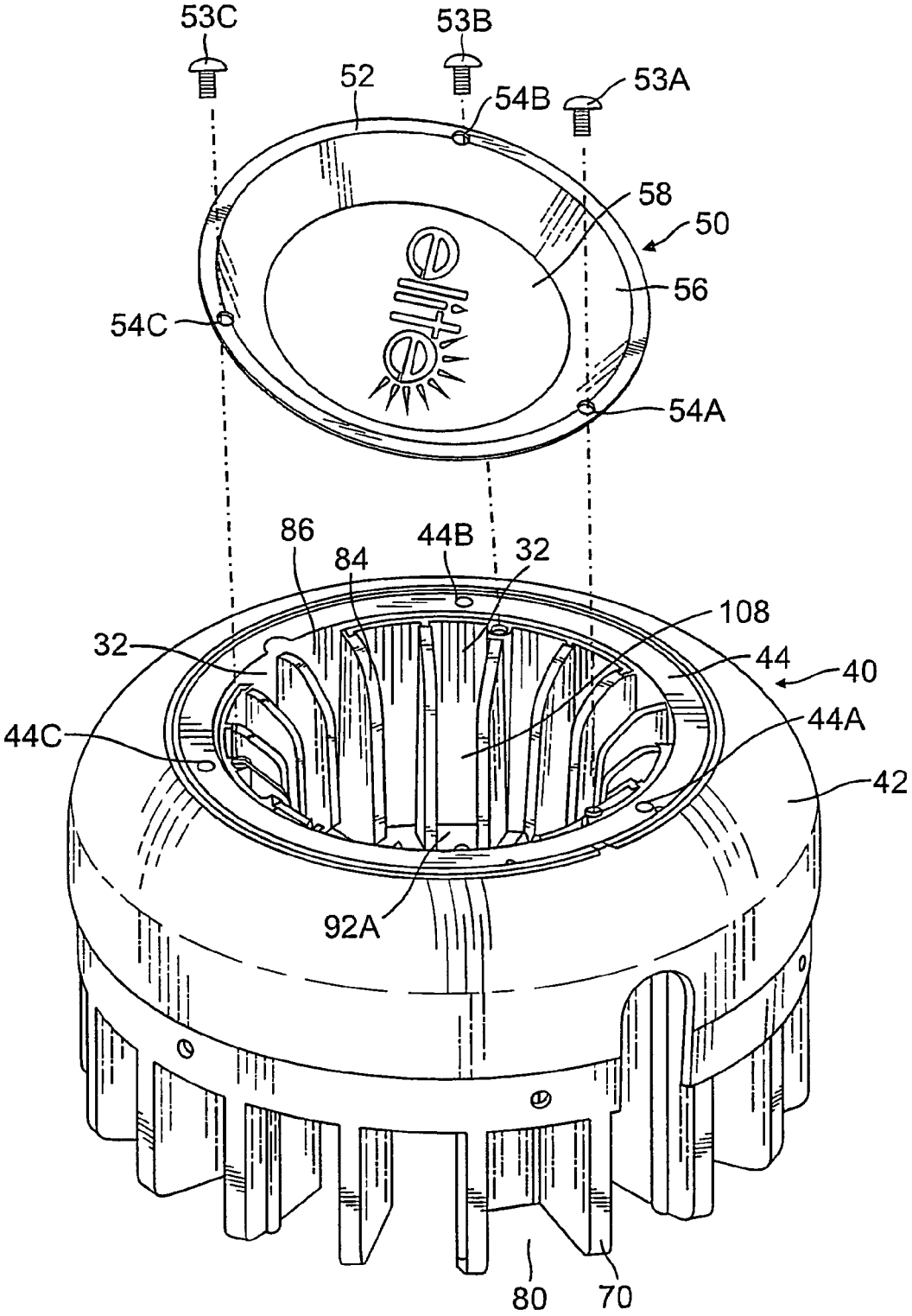
FIG. 7 is an exploded perspective view illustrating the top cap removed from the top of the canister to illustrate the heat dissipating veins or fins when viewed from the top of the canister.

The key innovation of the present invention is illustrated in FIGS. 5, 6 and 7. The cover 40 is now made out of heavy cast aluminum or other strong metal with a circumferential heat sink cast into the interior of the cover 40. The heat sink 60 is comprised of a multiplicity of spaced apart lower veins or fins 70 which are separated by air gaps 80 and a multiplicity of upper veins or fins 84 which are separated by air gaps 86. In one design as illustrated in FIG. 6, each lower fin 70 extends outwardly to an exterior end 72, which connects to an interior surface 38 of the sidewall 20 and a circumferential interior rim 38A which is formed adjacent the interior surface of the sidewall 20.

At the opposite interior end 74 most of the fins 70 are attached to a respective one of partial interior vertical walls 90, 90A and 90B. At least one fin and in the embodiment shown, three air fins, are now attached to a partial interior vertical wall. An interior horizontal separation plate 88 is affixed to partial interior walls 90, 90A and 90B. Therefore, a lower interior heat dissipation chamber or air gap chamber 106 is formed by the lower surface 92 of interior horizontal separation plate 88, the partial interior vertical walls 90, 90A and 90B and some of the lower fins 70.

As illustrated in FIGS. 6 and 7, the upper fins 84 are located above the interior horizontal separation plate 88 and rest on its upper surface 92A and are attached to the interior wall 32 of canister 10. The upper fins or veins 84 extend radially inward from the interior sidewall 32 and with the upper surface 92A of horizontal separation plate 88 form an upper interior heat dissipation chamber or air gap chamber 108.

It will be appreciated that the thickness and width of the adjacent air gaps for the respective upper and lower fins or veins are optimized so that the present invention can apply a minimum surface area for each fin or vein to achieve a maximum heat exchange and heat dissipation.

Referring to FIG. 6, the LED chip 150 has a preferred rectangular shape, wherein LED 152 is positioned on a center of a front side of the chip, and thermal conductive grease 157 is positioned on a rear side. Four connecting openings 156 are positioned at the respective four corners of the chip. Therefore, the LED chip can be affixed to the lower surface 92 of horizontal separation plate 88 by affixing means such as screws. It will be appreciated that, with the aid of the special design having the four connecting openings and thermal conductive grease, the present invention LED chip can be evenly affixed to the lower surface 92 of the horizontal plate 88 to thereby achieve an efficient heat transfer, wherein heat generated from the LED 152 in use is transferred to the upper and lower fins, contoured exterior surface 42 and recessed sealing cap 50 of the domed cover 40 for an effective heat dissipation.

It will be appreciated that the present invention utilizes the single LED chip, as compared with the prior art using multiple chips. Therefore, the present invention is advantageous in terms of easy manufacturing and maintenance of the lighting luminaire, and allows better control of light distribution and less possible points of failure. In addition, the LED chip is removably attached to the transverse plate, so that the LED chip can be easily replaced and/or upgraded. This LED replaceable feature provides the benefit that the present invention luminaire will not become obsolete as LED technology advances since the LED chip can be replaced with an upgraded chip.

As further illustrated in FIGS. 6 and 12, the LED 152 is connected at an inlet connecting point 153 by wire 160 which is soldered a that point and an outlet connecting point 154 by wire 165 which is soldered at that point, which are printed on the LED chip 150. The wire 160 is connected to a first mating connecting member 161, which can be a female member. The first mating connecting member 161 can connect to a second mating connecting member 162 that is connected to a wire 164, wherein the second mating connecting member 162 can be a male member, so that the first and second mating connecting members 161 and 162 are matched to each other to form a first single pole detachable connector. Similarly, the outlet connecting line 165 connects to a third mating connecting member 166. The third mating connecting member 166 matches to a fourth mating connecting member 167 that connects to a wire 168, wherein the third and fourth mating connecting members 166 and 167 form a second single pole detachable connector. As additionally illustrated in FIG. 12, the wires 164 and 168 are wired to the electrical junction box 260 through conduit 170.

It will be appreciated that having the first and second detachable connectors is an important innovation of the present invention. With the application of the detachable connectors, the present invention can avoid damage to the wires during installation of the lighting fixture which prevents twisting of the wires during installation. The fixture can be partially installed in the ceiling opening and then the connection of the respective detachable single pole connectors can be conducted so that the wires are not twisted during installation.

Therefore, through the present invention, heat dissipation fins or veins 70 and 84 are formed into the canister cover 40 and extend radially inward from the interior canister sidewall to form an upper air heat dissipation chamber 108 and a lower air heat dissipation chamber 106, the air circulating within the gaps between the respective veins or fins.

In the present invention, the top of the canister is modified to have a heat sink incorporated into the top of the canister. The canister has been modified to have a heavy cast aluminum top with interior fins and a depressed cap so that the heat from the LED or other illumination source is dissipated by the heat sink on the top of the canister. In prior art designs, there is no such heat sink and the metal canister is just thick aluminum so that the LED can heat up to 90 degrees centigrade. It is within the spirit and scope of the present invention to have only the upper veins 84 or to have only the lower veins 70 or to have both.

The benefit of the present invention is that it allows the LED chip 150 to run cooler than the prior art designs. In the present invention the LED runs between 70 degrees centigrade and 75 degrees centigrade which is fifteen degrees centigrade lower than the maximum that the manufacturer allows. The heat sink which comprises at least one set of fins or veins incorporated into the top of the canister therefore enables the LED to have a longer life.

Another innovation is that the sealing cap 50 on the top of the canister is indented so that it goes into the well or upper air heat dissipating chamber 108 which is surrounded by the upper fins 84 so that it creates greater surface area for heat dissipation. This is much more effective than if the sealing cap were flat along the top of the canister. The plate 88 at the bottom of the upper heat sink has interior holes 176 which allows for further dissipation of heat. In addition, inside the canister itself there are interior lower veins or fins 70 which further serve to dissipate the heat.

Referring to FIGS. 9*a* and 10, there is illustrated a first embodiment 170 of a light reflector of the present invention. The reflector 170 is a hollow circular wall including a top inward rim 174 with a top opening 172. The top inward rim 174 further has two identical transverse inward extensions 176, which extend into top opening 172 at respective opposite positions of the circular rim 174. The wall downwardly and outwardly expands to form an exterior surface 178 which ends in a bottom circumference 180 having a rim 181 which surrounds a bottom opening 182, wherein the wall expands adjacent the bottom circumference 180 to thereby have the shape of a skirt.

As illustrated in FIGS. 6 and 13, a pair of the light reflector retaining means 184 and 186 are positioned on the lower surface 92 of the transverse plate 88, which are symmetrical to the LED 152 that serves as the center of symmetry for the luminaire. In addition, the light reflector retaining means are positioned slightly lower than the lower surface 92 of the plate 88, so that there are gaps between the respective retaining means 184 and 186 and the lower surface 92. In this setting, as illustrated in FIG. 13, when assembling the light reflector 170 into the canister cover 40, the two identical transverse inward extensions 176 are pressed and twisted to be positioned onto retaining means 184 and 186 and then retained within the respective gaps under the respective retaining means 184 and 186.

The present invention has various alternative embodiments of the light reflectors with respect to their shapes while each alternative embodiment maintains the same bottom structure having a bottom circumference to surround a bottom opening and same top structure having an interior inward ring that includes two sections having the transverse inward extensions. An alternative embodiment 188 of the light reflectors is illustrated in FIG. 9*c*, where the reflector has the shape of a frustum in the longitudinal cross section to thereby have a circular frustum shaped exterior surface 190. It will be appreciated that the embodiment 188 serves as a reference regarding the shapes of the respective light reflectors. As compared with the embodiment 188, referring to FIG. 9*b*, another alternative embodiment 192 has a convex circular exterior surface 194. In addition, it will be appreciated that the embodiment 170 has a concave circular exterior surface 178, as compared with the exterior surface 190 of the embodiment 188 of the light reflector.

The lens of the present invention is round in shape and affixed to the replaceable reflector so that the lens in effect is also replaceable. The lens can be transparent, frosted or translucent depending on the desired lighting effect. Referring to FIGS. 14A and 14B, there is illustrated first embodiment 196A of the lens, wherein an exterior surface 198 is frosted and an interior surface 200 is smooth, so that the LED is concealed. The first embodiment of the lens causes a light effect which has a spot image as it shines down from the ceiling. As illustrated in FIGS. 14C and 14D, a second embodiment 196B of the lens includes an exterior surface 202 that is frosted and an interior surface 204 that is sanded and rough, so that the lens generates a light effect which has a widely dispersed image. As illustrated in FIGS. 14E and 14F, a third embodiment 196C of the lens is comprised of an exterior surface 206, which has a multiplicity of evenly distributed raised prisms or spots 207 throughout the surface extending perpendicularly away therefrom, as compared with the interior surface 208 which can either be smooth or sanded. Therefore, the lens 196C generates a light effect which has a more widely dispersed image, as compared with the second embodiment 196B of the lens.

It will be appreciated that in the present invention each lens is adhered to the bottom circumference 180 of the light reflector having the respective various shapes, so that it is convenient to achieve a desired lighting effect by using a light reflector affixed with a lens that is designed to have the desired lighting effect. Since the reflector is replaceable, the lens is therefore also replaceable.

Another innovation of the present invention is the incorporation of interchangeable trims with interchangeable lenses to provide a combination of trim and lens to suit any desired purpose. The trim can have two alternative configurations which are retained within the canister 10 by different connecting means. Each of the alternative trim configurations can retain any one of the multiplicity of lenses as described below.

Referring to FIG. 11A, there is illustrated bottom ring cove or trim 202 of the present invention. The trim or ring cover 202 includes an ascending circular wall 208, which is connected at its bottom circumference to a transverse ring 204 that surrounds a bottom opening 205 of the ring cover. In addition, a circular vertical wall 206 is connected to a circular joint where the ascending circular wall 208 connects to the transverse ring 204 to thereby form a circular air gap 210. The ascending circular wall 208 at its top connects to a circular transverse inward rim 212 which surrounds a top opening 214 of the ring cover. The top circular inward rim 212 also includes a pair of connecting springs 216 which are positioned at opposite locations of the circular inward rim, wherein each identical spring 216 has a bent top end 218. For this configuration, the connecting springs have their bent top ends 218 respectively received within oppositely disposed retaining hooks 220 and 222 illustrated in FIG. 13. The interior of trim embodiment 202 illustrated in FIG. 11A can have any multiplicity of interior reflector surface combinations. Referring to FIG. 11B, the trim 202B can have an interior reflector surface 214B which is smooth. Referring to FIG. 11C, the trim 214C can have an interior reflector surface 214C which is baffled. It is also within the spirit and scope of the present invention to have a trim with an interior reflector surface which is partially smooth and partially baffled.

An alternative configuration for the interchangeable trim used with the present invention is illustrated in FIGS. 11D through 11I. Referring to FIGS. 11D and 11E, the trim 202D has a trim ring 204D which extends to a reflector surface 214D which is baffled. The mechanism by which the trim 204D is retained within the canister 10 is by a pair of oppositely disposed torsion springs 216D and 216E each having oppositely disposed hook members 218D and 218E at the distal ends of the torsion springs. The torsion springs are retained within the canister by a pair of oppositely disposed torsion spring retaining members, one of which 220A is illustrated in FIG. 13. The hook members 218D are retained in hook receiving portions 220D of spring retaining member 220A. It will be appreciated that an oppositely disposed torsion spring retaining member retains hook members 218E. Referring to FIGS. 11F and 11G the trim 202F has a trim ring 204F which extends to a reflector surface 214F which is smooth. The mechanism by which the trim 204F is retained within the canister 10 is by a pair of oppositely disposed torsion springs 216F and 216G each having oppositely disposed hook members 218F and 218G at the distal ends of the torsion springs. The torsion springs are retained within the canister by a pair of oppositely disposed torsion spring retaining members, one of which 220A is illustrated in FIG. 13. The hook members 218F are retained in hook receiving portions 220D of spring retaining member 220A. It will be appreciated that an oppositely disposed torsion spring retaining member retains hook members 218G. Referring to FIGS. 11H and 11I, the trim 202H has a trim ring 204H which extends to a reflector surface 214H which is partially baffled and partially smooth. The mechanism by which the trim 204H is retained within the canister 10 is by a pair of oppositely disposed torsion springs 216H and 216I each having oppositely disposed hook members 218H and 218I at the distal ends of the torsion springs. The torsion springs are retained within the canister by a pair of oppositely disposed torsion spring retaining members, one of which 220A is illustrated in FIG. 13. The hook members 218H are retained in hook receiving portions 220D of spring retaining member 220A. It will be appreciated that an oppositely disposed torsion spring retaining member retains hook members 218I.

Each of the trims illustrated I FIGS. 11A through 11I retains a lens. If the lens is aligned with the trim ring, it is a flush mounted lens. Referring to FIGS. 11J and 11K, the trim 202J has a trim ring 204J and the trim 202J retains a lens 300 which is flush mounted. The flush mounted lens is 300 is a prismatic kens. Alternatively, the lens can be recessed into the reflector and away from the trim ring. Referring to FIGS. 11T and 11U, the trim 202T has a trim ring 204J and the trim 202T retains a lens 400 which is recessed. The recessed lens 400 is a fresnel lens.

It is also within the spirit and scope of the present invention to have any desired lens retained by the light reflectors illustrated in FIGS. 9*a*, 9, 9*c* and 10, and by any of the trims illustrated in FIGS. 1A through 11K and 11T through 11U. In addition to all of the lenses already described, the following additional lenses can be used: FIG. 11L illustrates a clear prismatic lens 300L. FIG. 11M illustrates a soft prismatic lens 300M. FIG. 11N illustrated a plastic prismatic lens 300N. FIG. 11O illustrated a sand blasted prismatic lens 3000. FIG. 11P illustrates a modified magnifying glass prismatic lens 300P. FIG. 11Q illustrated an opaque prismatic lens 300Q. FIG. 11R illustrates a lens 500 with the center 502 is clear and the outer ring frosted. FIG. 11S illustrates a lens 600 where the center 602 is frosted and the outer ring 604 is clear. FIGS. 11V and 1W illustrate an opaque recessed lens 400V.

As additionally illustrated in FIG. 13, the canister is affixed to the mounting fixture 110, wherein the bottom circumference 22 of the canister is positioned higher than the mounting fixture that is positioned within it. In addition there is a circular foam of elastic materials 23 that is positioned where the canister 20 joins the mounting fixture 110.

When assembling of the bottom ring cover 202 into the canister 20 that is fixed by a light reflector having a desired lens, the bent top ends 218 of the respective two springs are elastically connected to the respective two hooks 220 and 222 that are positioned on the transverse plate 88 adjacent the respective partial interior vertical walls 90A and 90B, which is better illustrated in FIGS. 3 and 6. In this setting, the circular bottom circumference 22 is positioned into an air space adjacent an exterior side of the circular vertical wall 206, wherein the circular foam 23 conceals a gap between the bottom end of the canister 20 and the circular vertical wall 206 of the ring cover. Trims 202B and 202C are similarly affixed.

The present invention has many unique features, which bring the respective benefits. First, the present invention has a domed cover 40 which is made of the heavy cast aluminum. The domed cover has a contoured top surface which maximizes and facilitates air flow to thereby contribute efficient heat dissipation. In addition, the domed cover 40 is designed to have a large radius and intimate contact with the sidewall 20 of the canister, which maximizes surface areas of the canister for efficient heat dissipation.

Second, the present invention has the upper and lower heat dissipation fins or veins, which have the respective large surface areas for an efficient heat dissipation. In addition, thickness and widths of the adjacent air gaps for each fin or vein are optimized so that the present invention can apply a minimum mass of each fin or vein to achieve maximum heat exchange.

Third, the present invention has a plurality of openings 176 positioned on the transverse plate 88, which promote air flow within the canister to thereby contribute to efficient heat dissipation.

Fourth, the present invention utilizes a single LED chip, which allows better control of light distribution and less possible points of failure.

Fifth, the LED chip 150 of the present invention has four connecting openings positioned at the respective corners of the chip. In addition, the present invention applies thermal conductive grease which is positioned on the rear side of the chip. Therefore, with application of four affixing means positioned at the respective corners of the chip, the chip can be evenly and removably positioned on the transverse plate for efficiently transferring heat generated by the LED in use and for easy replacement when there are needs for repairing and upgrading the LED chip.

Sixth, the present invention has the recessed sealing cover which provides a large surface area for the heat dissipation and facilitates compliance with the local state regulations.

Seventh, the present invention uses a replaceable light reflector and lens designed for generating a specific lighting effect, so that the present invention is able to provide a narrow flood, flood and wide flood lighting effect.

Eighth, the present invention utilizes hanger bars which can be installed on longer or shorter sides of the housing, which is versatile for installation of the luminaire to a building structure.

Ninth, present invention facilitates the use of interchangeable trims and interchangeable reflectors which accommodate any desired type of lens.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A luminaire for use as a recessed lighting fixture, the luminaire having a canister comprising:

a. a cylindrical sidewall and a domed cover having an interior wall, the cylindrical sidewall enclosing an interior chamber and the domed cover enclosing the interior chamber under the domed cover, the domed cover including an opening in its top surface and a sealing cap removably affixed to the domed cover to enclose the opening, the sealing cap having a recessed interior surface which extends into the interior chamber under the domed cover;

b. means for retaining a source of illumination within the canister;

c. a first heat sink comprised of a multiplicity of spaced apart lower air fins which are separated by air gaps, the multiplicity of lower air fins supported within the interior chamber of the canister and extending radially inwardly from the interior sidewall;

d. a second heat sink comprised of a multiplicity of upper air fins separated by air gaps, the upper air fins extending interior from the interior wall of the domed cover; and e. the upper and lower heat sinks causing air to circulate within the canister and through the air gaps separating the upper air fins and the lower air fins to thereby dissipate heat generated from the source of illumination.

2. A luminaire for use as a recessed lighting fixture, the luminaire having a canister comprising:

a. a cylindrical sidewall and a domed cover having an interior wall, the cylindrical sidewall enclosing an interior chamber and the domed cover enclosing the interior chamber under the domed cover, the domed cover including an opening in its top surface and a sealing cap removably affixed to the domed cover to enclose the opening, the sealing cap having a recessed interior surface which extends into the interior chamber under the domed cover;

b. means for retaining a source of illumination within the canister;

c. a heat sink comprised of a multiplicity of spaced apart lower air fins which are separated by air gaps, the multiplicity of lower air fins supported within the interior chamber of the canister and extending radially inwardly from the interior sidewall; and d. the heat sink causing air to circulate within the canister and through the air gaps separating the lower air fins to thereby dissipate heat generated from the source of illumination.

3. A luminaire for use as a recessed lighting fixture, the luminaire having a canister comprising:

a. a cylindrical sidewall and a domed cover, the cylindrical sidewall enclosing an interior chamber and the domed cover enclosing the interior chamber under the domed cover, the domed cover including an opening in its top surface and a sealing cap removably affixed to the domed cover to enclose the opening, the sealing cap having a recessed interior surface which extends into the interior chamber under the domed cover;

b. means for retaining a source of illumination within the canister;

c. a heat sink comprised of a multiplicity of upper air fins separated by air gaps, the upper air fins extending interiorly from the interior wall of the domed cover; and d. the heat sinks causing air to circulate within the canister and through the air gaps separating the upper air fins to thereby dissipate heat generated from the source of illumination.

4. A luminaire for use as a recessed lighting fixture, the luminaire having a canister comprising:

a. a cylindrical sidewall with an interior sidewall and a domed cover with an interior recessed surface, the cylindrical sidewall enclosing an interior chamber and the domed cover enclosing the interior chamber under the domed cover, the domed cover including an opening in its top surface and a sealing cap removably affixed to the domed cover to enclose the opening, the sealing cap having a recessed interior surface which extends into interior chamber under the domed cover;

b. an interior horizontal separation plate having an upper surface and a lower surface extending across a portion of an interior chamber, an which divides the chamber into an upper interior air gap chamber and a lower interior air gap chamber, a source of illumination affixed to the lower surface of the interior horizontal separation wall;

c. a first heat sink comprised of a multiplicity of spaced apart lower air fins which are separated by air gaps, the multiplicity of lower air fins supported within the interior chamber of the canister, some of the multiplicity of lower fins and extending radially inwardly from an interior surface of the interior sidewall to the horizontal separation wall, a multiplicity of interior vertical sidewalls affixed to the lower surface of the interior horizontal separation plate and affixed to some of the lower air fins, a lower air gap chamber formed by the lower surface of the interior horizontal separation plate, the multiplicity of interior vertical sidewalls, and some of the lower air fins;

d. a second heat sink comprised of a multiplicity of upper air fins separated by air gaps, the upper air fins located above the interior horizontal separation plate and resting on the upper surface of the interior horizontal separation plate and extending radially inwardly from the interior sidewall to the upper surface of the interior horizontal separation plate, an upper interior air gap chamber formed by the upper surface of the interior horizontal separation plate, the interior surface of the domed cover and horizontal sidewall and upper air fins; the recessed interior surface of the sealing cap extending into the upper interior air gap chamber; and e. the second and first heat sinks causing air to circulate within the upper interior air gap chamber, the lower interior air gap chamber, and through the air gaps separating the upper air fins and the lower air fins to thereby dissipate heat generated from the source of illumination.

5. The luminaire in accordance with claim 4 wherein the domed cover and upper air veins and lower air veins of the canister are formed of cast aluminum.

6. The luminaire in accordance with claim 4 wherein the interior horizontal separation plate further comprises a multiplicity of openings to permit air circulation between the lower air gap chamber and the upper air gap chamber.

7. The luminaire in accordance with claim 4 further comprising electrical wires having separable mating connecting members for connecting the luminaire to a source of power.

8. The luminaire in accordance with claim 4 wherein the canister is retained on a mounting fixture having a pair of oppositely disposed parallel long sides and a pair of opposite disposed parallel short sides which are respectively perpendicular to the long sides, the mounting fixture having a pair of oppositely disposed hanger bars with each hanger bar having oppositely disposed mounting brackets by which the mounting fixture is affixed to beams in a ceiling of a structure, the short sides having hanger bar retaining members which enable the hanger bars to be retained on the oppositely disposed short sides, and the long sides having hanger bar retaining members which enable the hanger bars to be retained on the oppositely disposed long sides.

9. The luminaire in accordance with claim 4 further comprising a trim ring cover which has a trim thereon, the ring cover having a pair of springs each having a bent top end, a pair of oppositely disposed hooks retained adjacent the lower surface of the interior transverse plate to respectively receive and retain a respective bent top end of a spring of the trim ring cover.

10. The luminaire in accordance with claim 9 wherein the trim ring cover retains a lens, the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

11. The luminaire in accordance with claim 9 where the trim ring comprises a baffle having a reflective surface selected from the group consisting of smooth, baffled, and part baffled and part smooth.

12. The luminaire in accordance with claim 4 further comprising a trim ring cover which has a trim thereon, the ring cover having a pair of torsion springs each having a hook end, a pair of oppositely disposed hook end retaining members in the interior of the canister sidewall to respectively receive and retain a respective hook end of a torsion spring of the trim ring cover.

13. The luminaire in accordance with claim 12 wherein the trim ring cover retains a lens, the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

14. The luminaire in accordance with claim 12 where the trim ring comprises a baffle having a reflective surface selected from the group consisting of smooth, baffled, and part baffled and part smooth.

15. The luminaire in accordance with claim 4 wherein the source of illumination is an LED chip.

16. The luminaire in accordance with claim 15 wherein the LED chip has a single LED which produces white light.

17. The luminaire in accordance with claim 15 wherein a layer of thermal grease is located between the LED chip and the lower surface of the interior horizontal separation plate.

18. The luminaire in accordance with claim 17 wherein the LED chip is generally rectangular in shape and is affixed to the lower surface of the interior horizontal separation plate by affixing means located adjacent the four corners of the LED chip.

19. The luminaire in accordance with claim 4 wherein the interior horizontal separation wall further comprises means to retain a reflector.

20. The luminaire in accordance with claim 19 wherein the reflector has an upper end which includes means to removably retain the reflector onto the interior horizontal separation wall and a lens retained at a location adjacent a lower end of the reflector.

21. The luminaire in accordance with claim 20 wherein the exterior shape of the reflector is selected from the group consisting of frustum shaped, convex circular shaped and concave circular shaped.

22. The luminaire in accordance with claim 20 wherein the lens has an exterior surface and an interior surface relative to the reflector, the surfaces of the lens selected from the group consisting of the exterior surface being frosted and the interior surface being smooth, the exterior surface being frosted and the interior surface being sanded, the exterior surface having a multiplicity of evenly distributed prisms extending perpendicularly away from the exterior surface and the interior surface beings smooth, and the exterior surface having a multiplicity of evenly distributed prisms extending perpendicularly away from the exterior surface and the interior surface beings sanded.

23. The luminaire in accordance with claim 20 wherein the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

24. A luminaire for use as a recessed lighting fixture, the luminaire having a canister comprising:

a. a cylindrical sidewall with an interior sidewall and a domed cover with an interior recessed surface, the cylindrical sidewall enclosing an interior chamber and the domed cover enclosing the interior chamber under the domed cover, the domed cover including an opening in its top surface and a sealing cap removably affixed to the domed cover to enclose the opening;

b. an interior horizontal separation plate having an upper surface and a lower surface extending across a portion of the interior chamber, and which divides the interior chamber into an upper interior air gap chamber and a lower interior air gap chamber, a source of illumination affixed to the lower surface of the interior horizontal separation plate;

c. an upper heat sink comprised of a multiplicity of upper air fins separated by air gaps, the upper air fins located above the interior horizontal separation plate and resting on the upper surface of the interior horizontal separation plate and extending radially inwardly from the interior sidewall to the upper surface of the interior horizontal separation plate, an upper interior air gap chamber formed by the upper surface of the interior horizontal separation plate, the interior surface of the domed cover and upper air fins; and d. the heat sink causing air to circulate within the upper air gap chamber, and through the air gaps separating the upper air fins to thereby dissipate heat generated from the source of illumination.

25. The canister in accordance with claim 24, the sealing cap having a recessed interior surface which extends into the at least one interior chamber under the domed cover.

26. The luminaire in accordance with claim 24 wherein the LED chip is generally rectangular in shape and is affixed to the lower surface of the interior horizontal separation plate by affixing means located adjacent the four corners of the LED chip.

27. The luminaire in accordance with claim 24 wherein the interior horizontal separation plate further comprises a multiplicity of openings to increase air circulation within the canister.

28. The luminaire in accordance with claim 24 further comprising electrical wires electrical wires having separable mating connecting members for connecting the luminaire to a source of power.

29. The luminaire in accordance with claim 24 wherein the canister is retained on a mounting fixture having a pair of oppositely disposed parallel long sides and a pair of opposite disposed parallel short sides which are respectively perpendicular to the long sides, the mounting fixture having a pair of oppositely disposed hanger bars with each hanger bar having oppositely disposed mounting brackets by which the mounting fixture is affixed to beams in a ceiling of a structure, the short sides having hanger bar retaining members which enable the hanger bars to be retained on the oppositely disposed short sides, and the long sides having hanger bar retaining members which enable the hanger bars to be retained on the oppositely disposed long sides.

30. The canister in accordance with claim 24 further comprising a lower heat sink comprised of a multiplicity of spaced apart lower air fins which are separated by air gaps, the multiplicity of lower air fins supported within the interior chamber of the canister, some of the multiplicity of lower air fins extending radially inwardly from the interior sidewall to the interior horizontal separation plate, a multiplicity of interior vertical sidewalls affixed to the lower surface of the interior horizontal separation plate and affixed to some of the lower air fins, a lower air gap chamber formed by the lower surface of the interior horizontal separation plate, the multiplicity of interior vertical sidewalls, and some of the lower air fins.

31. The canister in accordance with claim 30 wherein the domed cover and upper air fins and lower air fins are formed of cast aluminum.

32. The canister in accordance with claim 24 wherein the source of illumination is an LED chip.

33. The luminaire in accordance with claim 32 wherein the LED chip has a single LED which produces white light.

34. The luminaire in accordance with claim 32 wherein a layer of thermal grease is located between the LED chip and the lower surface of the interior horizontal separation plate.

35. The luminaire in accordance with claim 24 further comprising a trim ring cover which has a trim thereon, the ring cover having a pair of springs each having a bent top end, a pair of oppositely disposed hooks retained adjacent the lower surface of the interior transverse plate to respectively receive and retain a respective bent top end of a spring of the trim ring cover.

36. The luminaire in accordance with claim 35 wherein the trim ring cover retains a lens, the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

37. The luminaire in accordance with claim 35 where the trim ring comprises a baffle having a reflective surface selected from the group consisting of smooth, baffled, and part baffled and part smooth.

38. The luminaire in accordance with claim 24 further comprising a trim ring cover which has a trim thereon, the ring cover having a pair of torsion springs each having a hook end, a pair of oppositely disposed hook end retaining members in the interior of the canister sidewall to respectively receive and retain a respective hook end of a torsion spring of the trim ring cover.

39. The luminaire in accordance with claim 38 wherein the trim ring cover retains a lens, the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

40. The luminaire in accordance with claim 38 where the trim ring comprises a baffle having a reflective surface selected from the group consisting of smooth, baffled, and part baffled and part smooth.

41. The luminaire in accordance with claim 24 wherein the interior horizontal separation wall further comprises means to retain a reflector.

42. The luminaire in accordance with claim 41 wherein the reflector has an upper end which includes means to removably retain the reflector onto the interior horizontal separation wall and a lens retained at a location adjacent a lower end of the reflector.

43. The luminaire in accordance with claim 41 wherein the exterior shape of the reflector is selected from the group consisting of frustum shaped, convex circular shaped and concave circular shaped.

44. The luminaire in accordance with claim 42 wherein the lens has an exterior surface and an interior surface relative to the reflector, the surfaces of the lens selected from the group consisting of the exterior surface being frosted and the interior surface being smooth, the exterior surface being frosted and the interior surface being sanded, the exterior surface having a multiplicity of evenly distributed prisms extending perpendicularly away from the exterior surface and the interior surface beings smooth, and the exterior surface having a multiplicity of evenly distributed prisms extending perpendicularly away from the exterior surface and the interior surface beings sanded.

45. The luminaire in accordance with claim 42 wherein the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

46. A luminaire for use as a recessed lighting fixture, the luminaire having a canister comprising:

a. a cylindrical sidewall with an interior sidewall and a domed cover with an interior recessed surface, the cylindrical sidewall enclosing an interior chamber and the domed cover enclosing the interior chamber under the domed cover, the domed cover including an opening in its top surface and a sealing cap removably affixed to the domed cover to enclose the opening;

b. an interior horizontal separation plate having an upper surface and a lower surface extending across a portion of the interior chamber, a source of illumination affixed to the lower surface of the interior horizontal separation plate;

c. a lower heat sink comprised of a multiplicity of spaced apart lower air fins which are separated by air gaps, the multiplicity of lower air fins supported within the interior chamber of the canister and some of the multiplicity of lower air fins extending radially inwardly from the interior surface of the cylindrical sidewall to the horizontal separation plate, a multiplicity of interior vertical sidewalls affixed to the lower surface of the interior horizontal separation plate and affixed to some of the lower air fins, a lower air gap chamber formed by the lower surface of the interior horizontal separation plate, the multiplicity of interior vertical sidewalls, and some of the lower air fins; and d. the lower heat sink causing air to circulate within the lower air gap chamber, and through the air gaps separating the lower air fins to thereby dissipate heat generated from the source of illumination.

47. The luminaire in accordance with claim 46 wherein the interior horizontal separation plate further comprises a multiplicity of openings to permit air circulation within the canister.

48. The luminaire in accordance with claim 46 further comprising electrical wires having separable mating connecting members for connecting the luminaire to a source of power.

49. The luminaire in accordance with claim 46 wherein the canister is retained on a mounting fixture having a pair of oppositely disposed parallel long sides and a pair of opposite disposed parallel short sides which are respectively perpendicular to the long sides, the mounting fixture having a pair of oppositely disposed hanger bars with each hanger bar having oppositely disposed mounting brackets by which the mounting fixture is affixed to beams in a ceiling of a structure, the short sides having hanger bar retaining members which enable the hanger bars to be retained on the oppositely disposed short sides, and the long sides having hanger bar retaining members which enable the hanger bars to be retained on the oppositely disposed long sides.

50. The canister in accordance with claim 46 further comprising an upper heat sink comprised of a multiplicity of upper air fins separated by air gaps, the upper air fins located above the interior horizontal separation plate and resting on the upper surface of the interior horizontal separation plate and extending radially inwardly from the interior sidewall to the upper surface of the horizontal separation plate, an upper interior air gap formed by the upper surface of the interior horizontal separation plate, the interior surface of the domed cover and upper air fins, the interior recessed surface of the sealing cap extending into the upper interior air gap chamber.

51. The canister in accordance with claim 50 wherein the domed cover and upper air fins and lower air fins are formed of cast aluminum.

52. The luminaire in accordance with claim 46 further comprising a ring cover which has a trim thereon, the ring cover having a pair of springs each having a bent top end, a pair of oppositely disposed hooks retained adjacent the lower surface of the interior transverse plate to respectively receive and retain a respective bent top end of a spring of the ring cover.

53. The luminaire in accordance with claim 52 wherein the trim ring cover retains a lens, the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

54. The luminaire in accordance with claim 52 where the trim ring comprises a baffle having a reflective surface selected from the group consisting of smooth, baffled, and part baffled and part smooth.

55. The luminaire in accordance with claim 46 further comprising a trim ring cover which has a trim thereon, the ring cover having a pair of torsion springs each having a hook end, a pair of oppositely disposed hook end retaining members in the interior of the canister sidewall to respectively receive and retain a respective hook end of a torsion spring of the trim ring cover.

56. The luminaire in accordance with claim 55 wherein the trim ring cover retains a lens, the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

57. The luminaire in accordance with claim 55 where the trim ring comprises a baffle having a reflective surface selected from the group consisting of smooth, baffled, and part baffled and part smooth.

58. The canister in accordance with claim 46 wherein the source of illumination is an LED chip.

59. The luminaire in accordance with claim 58 wherein the LED chip has a single LED which produces white light.

60. The luminaire in accordance with claim 58 wherein a layer of thermal grease is located between the LED chip and the lower surface of the interior horizontal separation plate.

61. The luminaire in accordance with claim 58 wherein the LED chip is generally rectangular in shape and is affixed to the lower surface of the interior horizontal separation plate by affixing means located adjacent the four corners of the LED chip.

62. The luminaire in accordance with claim 46 wherein the interior horizontal separation wall further comprises means to retain a reflector.

63. The luminaire in accordance with claim 62 wherein the exterior shape of the reflector is selected from the group consisting of frustum shaped, convex circular shaped and concave circular shaped.

64. The luminaire in accordance with claim 62 wherein the reflector has an upper end which includes means to removably retain the reflector onto the interior horizontal separation plate and a lens retained at a location adjacent a lower end of the reflector.

65. The luminaire in accordance with claim 64 wherein the lens has an exterior surface and an interior surface relative to the reflector, the surfaces of the lens selected from the group consisting of the exterior surface being frosted and the interior surface being smooth, the exterior surface being frosted and the interior surface being sanded, the exterior surface having a multiplicity of evenly distributed prisms extending perpendicularly away from the exterior surface and the interior surface beings smooth, and the exterior surface having a multiplicity of evenly distributed prisms extending perpendicularly away from the exterior surface and the interior surface beings sanded.

66. The luminaire in accordance with claim 64 wherein the lens selected from the group consisting of prismatic, fresnel, clear prismatic, soft prismatic, plastic prismatic, sand blasted prismatic, modified magnifying glass prismatic, opaque prismatic, center clear exterior frosted, center frosted exterior clear, recessed fresnel and opaque recessed.

* * * * *